US011350763B1

(12) United States Patent
Stitchick et al.

(10) Patent No.: US 11,350,763 B1
(45) Date of Patent: Jun. 7, 2022

(54) BABY DIAPER CHANGING STATION

(71) Applicant: Foundations Worldwide, Inc., Medina, OH (US)

(72) Inventors: David Stitchick, Wadsworth, OH (US); Joseph A Lawlor, Medina, OH (US); Connor Doris, Strongsville, OH (US); Lukasz S. Poslowski, Palm Harbor, OH (US)

(73) Assignee: Foundations Worldwide, Inc., Medina, OH (US)

( * ) Notice: Subject to any disclaimer, the term of this patent is extended or adjusted under 35 U.S.C. 154(b) by 194 days.

(21) Appl. No.: 16/735,828

(22) Filed: Jan. 7, 2020

Related U.S. Application Data

(60) Provisional application No. 62/791,079, filed on Jan. 11, 2019.

(51) Int. Cl.
*A47D 5/00* (2006.01)
*A47D 15/00* (2006.01)

(52) U.S. Cl.
CPC ..... *A47D 5/006* (2013.01); *A47D 5/003* (2013.01); *A47D 15/008* (2013.01)

(58) Field of Classification Search
CPC ..... A47D 5/00; A47D 5/003; A47D 5/006; A47D 15/00; A47D 15/008
See application file for complete search history.

(56) References Cited

U.S. PATENT DOCUMENTS 3,999,490 A 12/1976 Rocker et al.
4,363,459 A 12/1982 Holzer
4,573,608 A 3/1986 Hansen
6,151,737 A 11/2000 Henninge
6,269,503 B1 8/2001 Betker
7,260,859 B2 8/2007 Helmsderfer
7,331,551 B2 2/2008 Oddsen, Jr.
7,426,765 B2 9/2008 Helmsderfer
8,079,104 B2 12/2011 Presnell et al.
8,099,810 B2 1/2012 Presnell et al.
8,276,229 B2 10/2012 Babikian et al.
8,365,328 B2 2/2013 Babikian et al.
8,375,490 B2 2/2013 Babikian et al.
2012/0198630 A1* 8/2012 Babikian ..... A47D 5/003 5/655

* cited by examiner

*Primary Examiner* — Fredrick C Conley

(74) *Attorney, Agent, or Firm* — Ralph E. Jocke; Walker & Jocke

(57) ABSTRACT

A baby diaper changing station (10) includes a base (16) that is configured to be in fixed connection with a wall (12). A table (14) is in movable rotatable connection with the base. The table is movable between a use position in which a changing surface (18) extends generally horizontal and faces upward, and a stored position in which the table extends parallel to the wall and in overlying relation of the base. The table is supported through rails (108, 110) that extend in respective channels (102, 104) within the table. Stop pins (154) are configured to stop rotation of the table in the use position and to prevent damage to the changing station from an excessive downward load on the table. The stop pins are frangible so that if an excessive load is applied, the pins bend and break without causing damage to other structures. The changing station can be returned to service by replacement of the stop pins.

36 Claims, 39 Drawing Sheets

90
91
88
28
86
87
92
157
98
96
94
100
96
160
156
144
142
140
116
137
144
136
162
161
138
148
132
108
146
158
151
150

12
244
10
14
16

BABY DIAPER CHANGING STATION

TECHNICAL FIELD

Exemplary arrangements relate to a baby diaper changing station. Exemplary arrangements further relate to a baby diaper changing station that provides improved stability and load bearing capability and that can be retracted to a more compact configuration when not in use.

BACKGROUND

Baby diaper changing stations are needed in public restrooms and other facilities. Some existing changing stations may be bulky and difficult to use. Because such units must be openly accessible, they may be subject to vandalism and breakage. Some existing changing stations may also be difficult to keep clean and sanitize.

Baby diaper changing stations may benefit from improvements.

SUMMARY

Exemplary arrangements comprise a baby diaper changing station that includes a base and a table. The base is affixed to a mounting surface such as a vertically extending wall. The table is rotationally movably mounted in supported connection with the base. The table is movable between a use position in which the table extends generally perpendicular to the wall and a stored position in which the table extends generally parallel to the wall and to the base.

The exemplary table and base are connected through a support structure that provides stability and significantly more than required load bearing capability for the table when in the use position. If the exemplary baby diaper changing station is subject to vandalism where the table is overloaded, a deformable and/or frangible mechanism is provided that releases the table from the use position without causing damage to the remainder of the support structure. The exemplary changing station can then be readily repaired and placed back in service.

Numerous useful features of exemplary arrangements will be discussed in the following Detailed Description.

BRIEF DESCRIPTION OF DRAWINGS

FIG. 4 is a right side view of the baby diaper changing station in the stored position.

FIG. 34 is a front plan view of the base.

FIG. 40 is an upper right side perspective view showing the relationship of the horizontally elongated mounting bracket and the base brackets, rails and axle shaft of the changing station.

DETAILED DESCRIPTION

Figure 1:
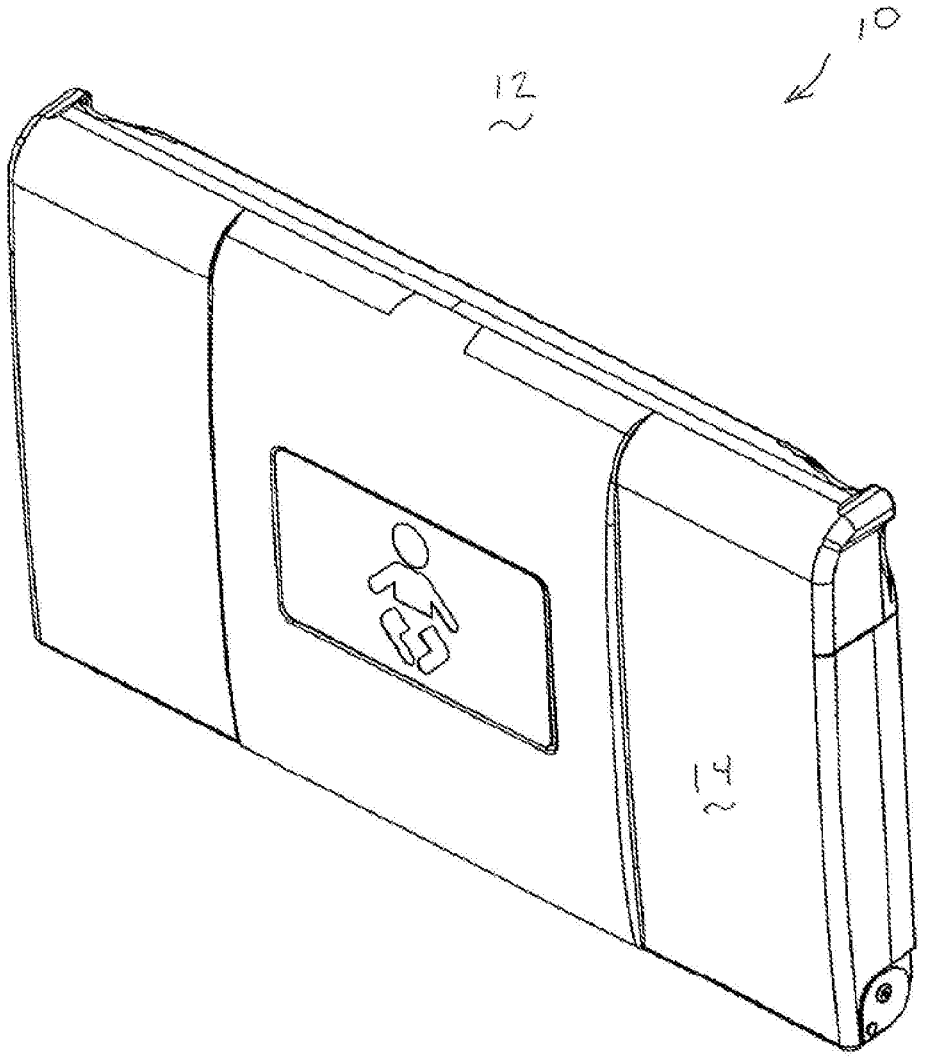
FIG. 1 is an upper front right perspective view of an exemplary arrangement of a baby diaper changing station in a stored position.
Figure 2:
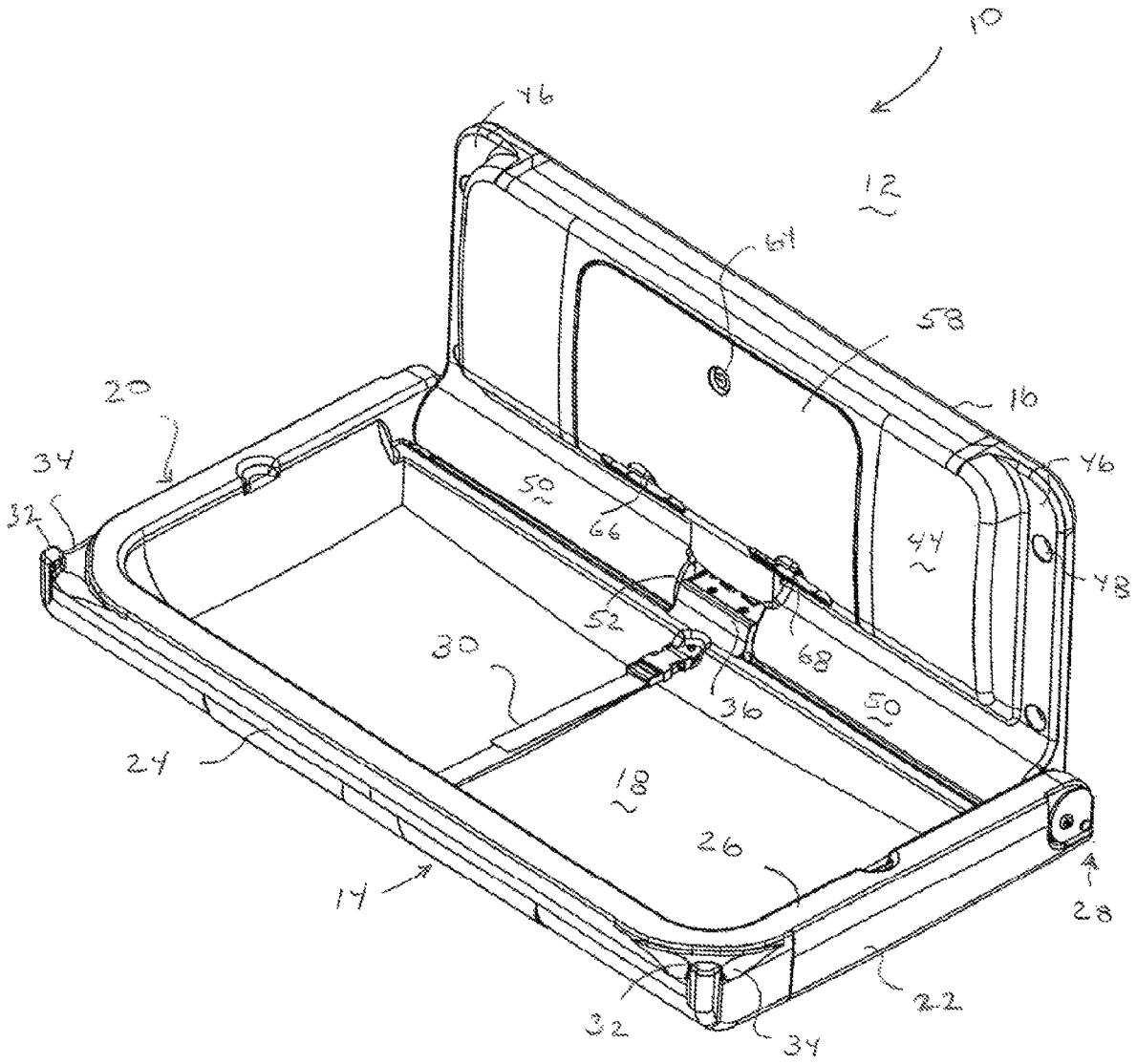
FIG. 2 is an upper front right perspective view of the baby changing station in a use position.
Figure 3:
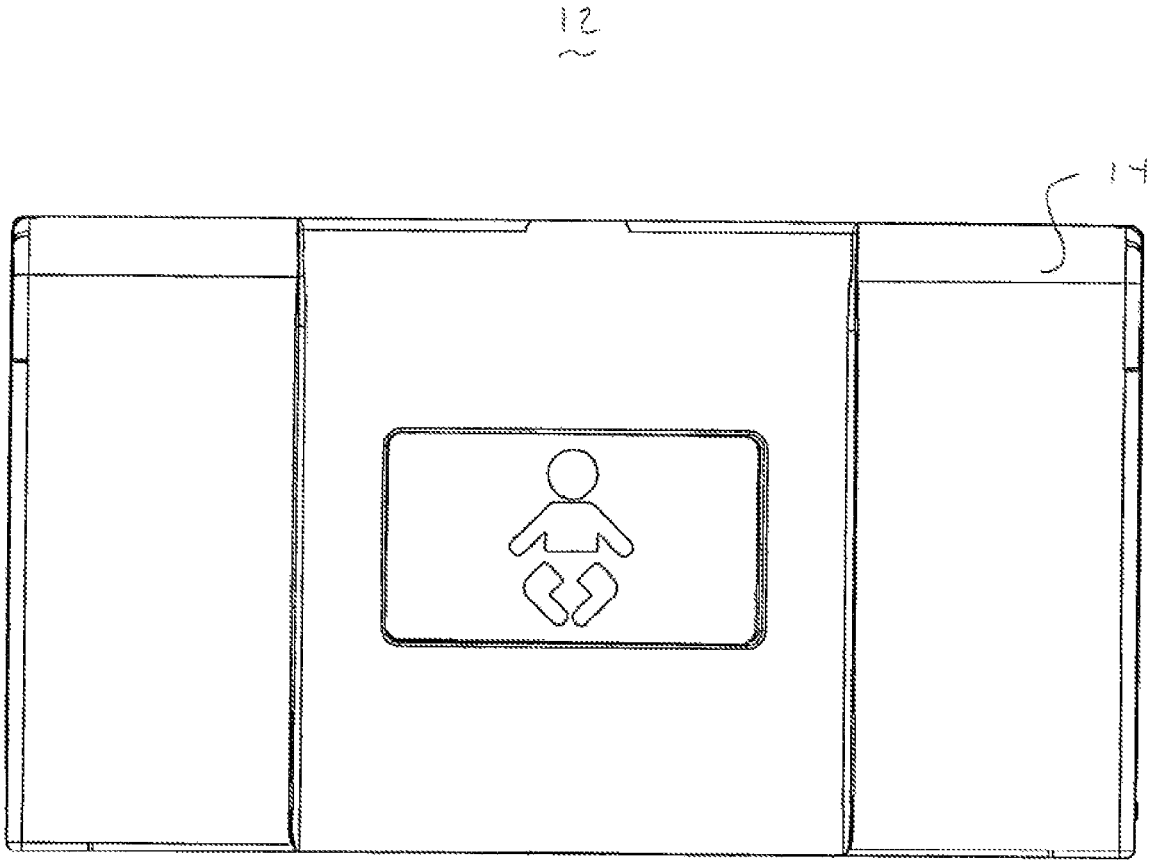
FIG. 3 is a front plan view of the baby diaper changing station in a stored position.
Figure 5:
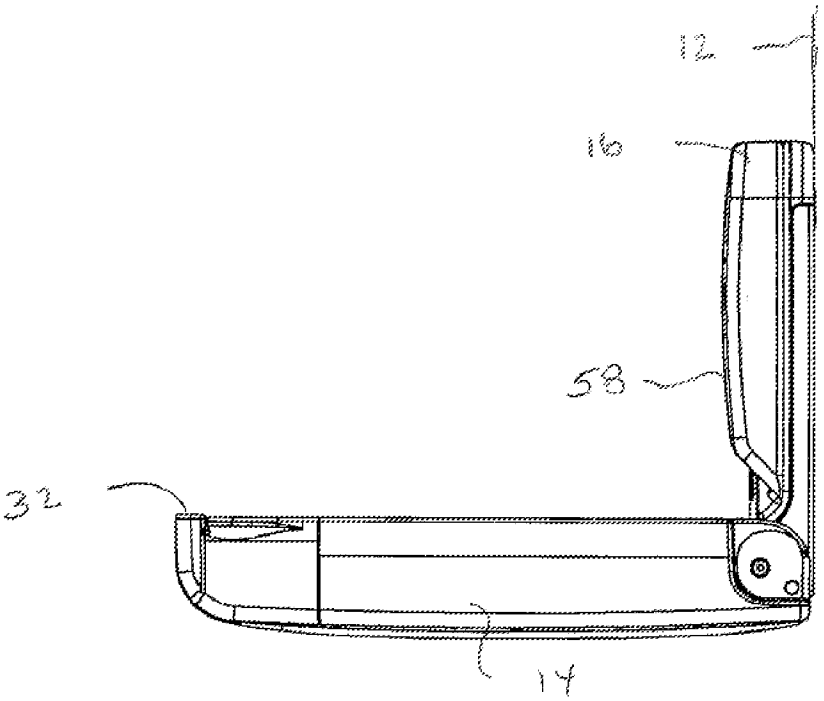
FIG. 5 is a right side view of the baby diaper changing station in the use position.
Figure 7:
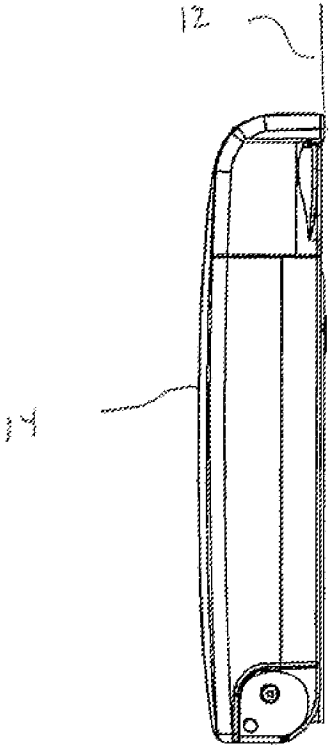
FIG. 7 is a top plan view of the table.
Figure 6:
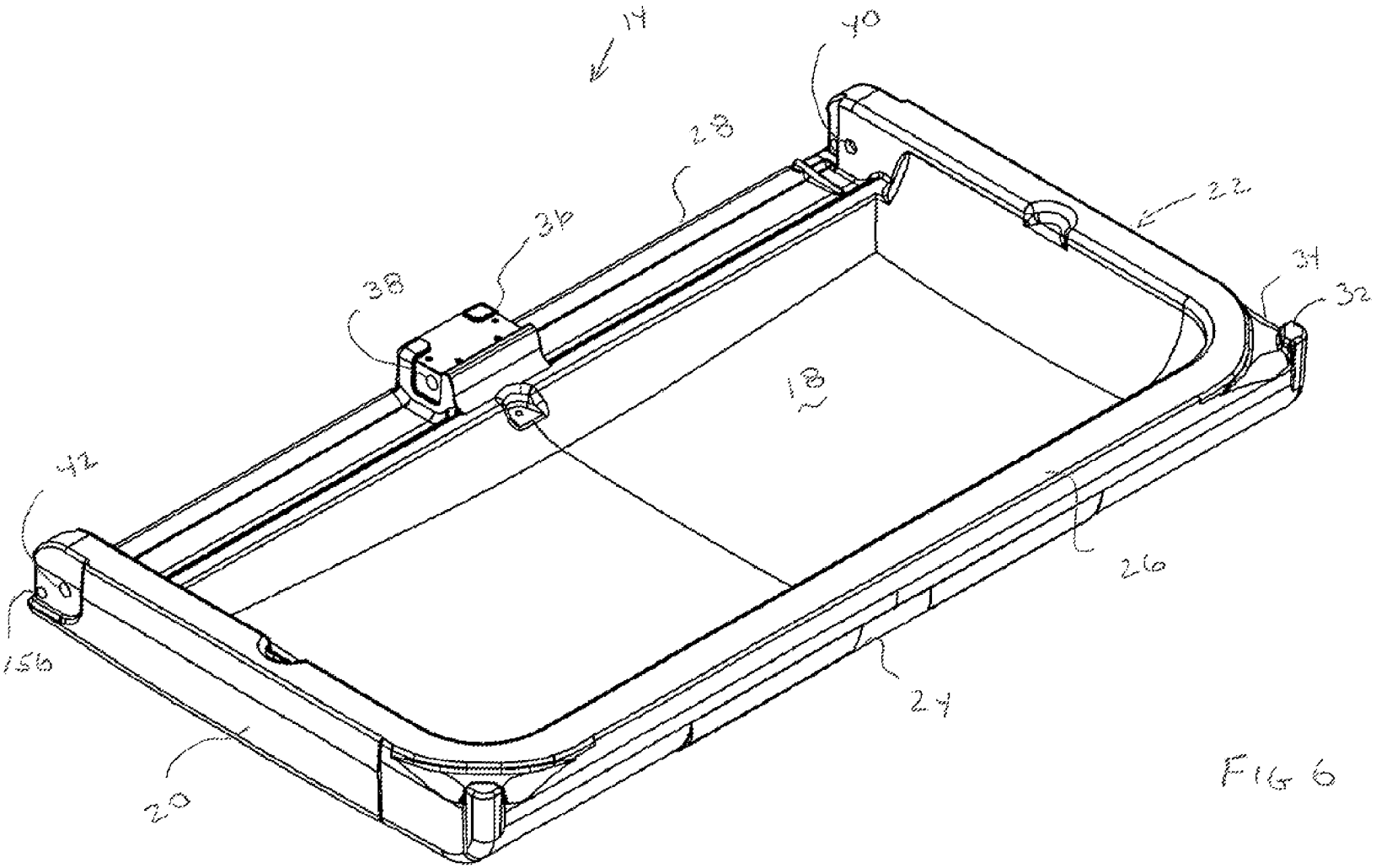
FIG. 6 is an upper front left perspective view of the table of the baby diaper changing station.
Figure 7:
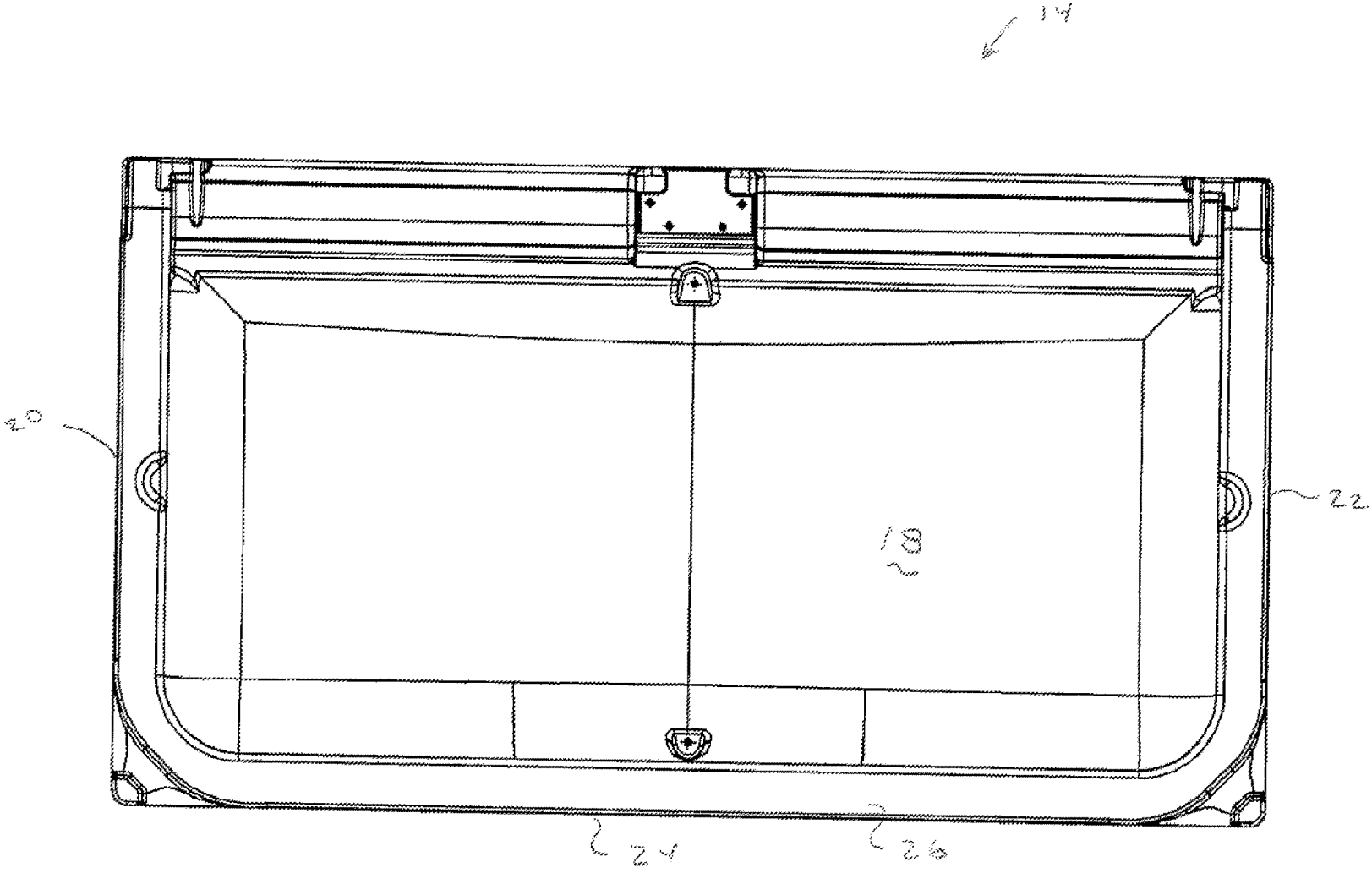
Figure 8:
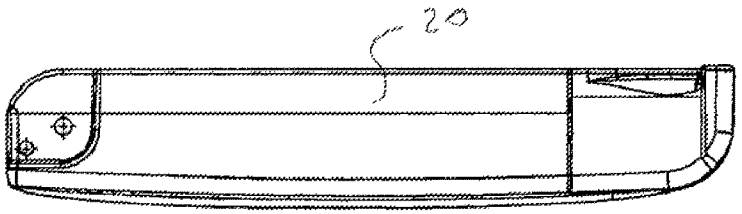
FIG. 8 is a left side view of the table.
Figure 9:
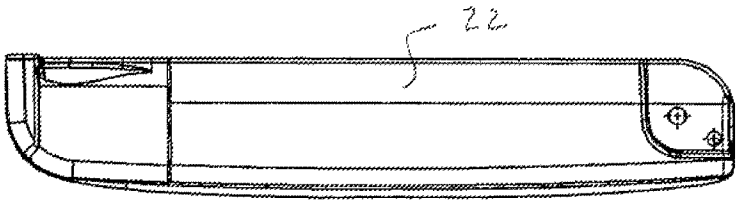
FIG. 9 is a right side view of the table.
Figure 10:
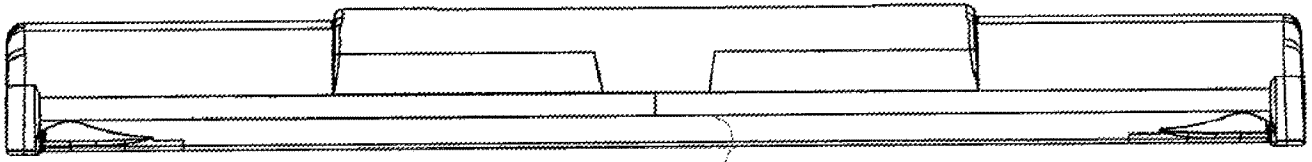
FIG. 10 is a front view of the table.

Referring now to the drawings and particularly to FIG. 1 there is shown therein an exemplary arrangement of a baby diaper changing station generally indicated 10. The exemplary changing station is mounted in operative attached connection with a vertically extending structure such as a wall 12. The exemplary changing station includes a table 14. As shown in FIG. 2, the changing station further includes a base 16 which is in direct attached connection with the wall 12. The table 14 is in rotatably movable attached connection with the base in a manner that is later discussed in detail.

In the exemplary arrangement the table is movable relative to the base between a stored position shown in FIG. 1 and a use position shown in FIG. 2. The table 14 includes a substantially planar changing surface 18. Substantially planar means most of the surface extends in a common plane. The table further includes a pair of transversely disposed side wall surfaces 20, 22 and an outer end surface 24. A rim 26 bounds the changing surface 18 adjacent to the side wall surfaces 20, 22 and the front wall surface 24. The exemplary table 14 further includes an inner end surface generally indicated 28.

In the use position of the changing station 10 as represented in FIG. 2, the changing surface 18 extends substantially horizontally and faces substantially upward. As used herein facing substantially upward means that a majority of the surface area faces substantially vertically upward. By substantially or generally horizontally it is meant horizontal plus or minus 20° therefrom. As used herein generally or substantially vertically means vertical plus or minus 20° therefrom. In the use position the changing surface 18 also extends outward and substantially normal to the wall 12. As used herein generally or substantially normal as well as generally or substantially perpendicular means at 90° plus or minus 20° therefrom. When the table 14 is in the use position the rim 26 extends upwardly and bounds the changing surface on 3 sides. Further in the exemplary arrangement the table 14 includes a strap assembly 30. The rim 26 of the exemplary table further includes thereon a pair of pegs 32. The pegs 32 extend upward when the table is in the use position from a peripheral surface 34 of the rim that extends adjacent to each respective peg. In the exemplary arrangement the table is comprised of molded plastic material. Of course it should be understood that this configuration is exemplary and in other arrangements other configurations and materials may be used.

As shown in greater detail in FIGS. 6-10 the exemplary table further includes a bearing block 36. The bearing block extends outward generally perpendicular to the changing surface 18 immediately adjacent to the inner end surface 28. The bearing block 36 includes a transverse opening 38 that extends therethrough. Opening 38 is sized for accepting an axle shaft therein as later discussed. Opening 38 is aligned with an opening 40 in the side wall surface 22 and an opening 42 in the side wall surface 20. Openings 40 and 42 are also configured for receiving outboard shaft portions of the axle shaft therein. Of course it should be understood that this configuration is exemplary and other arrangements other configurations may be used.

As shown in FIG. 2 and FIGS. 11-15, the exemplary base 16 includes a central portion 44 and a pair of outboard flange portions 46. The central portion 44 extends forwardly of the flange portions. The flange portions 46 include openings 48 that are configured to have fastening anchors extend therethrough so that the base 16 is held in fixed engagement with the wall 12. The exemplary base 16 further includes forward projecting portions 50. The forward projecting portions 50 are separated by a gap 52.

Figure 11:
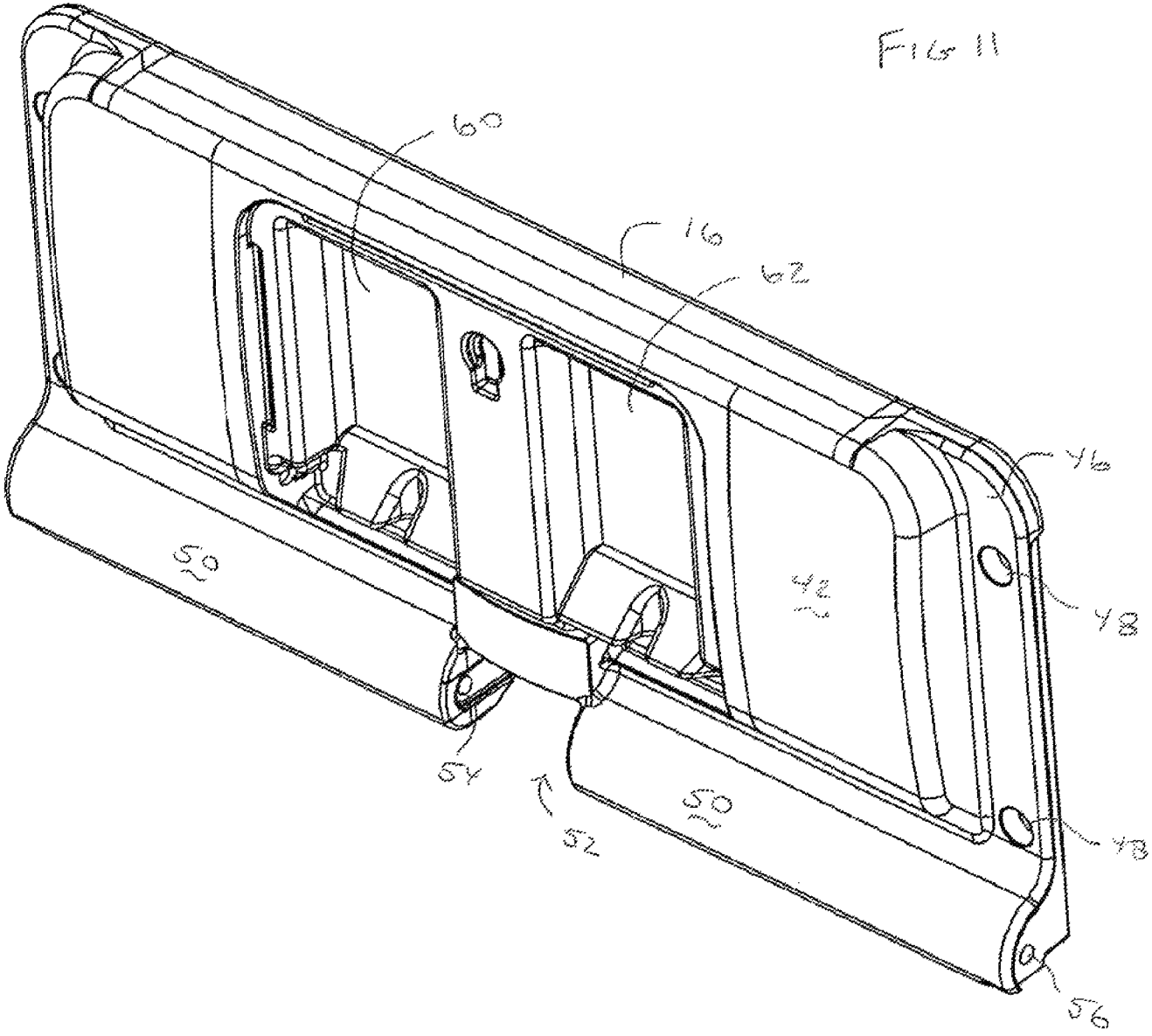
FIG. 11 is an upper right perspective view of the base.
Figure 12:
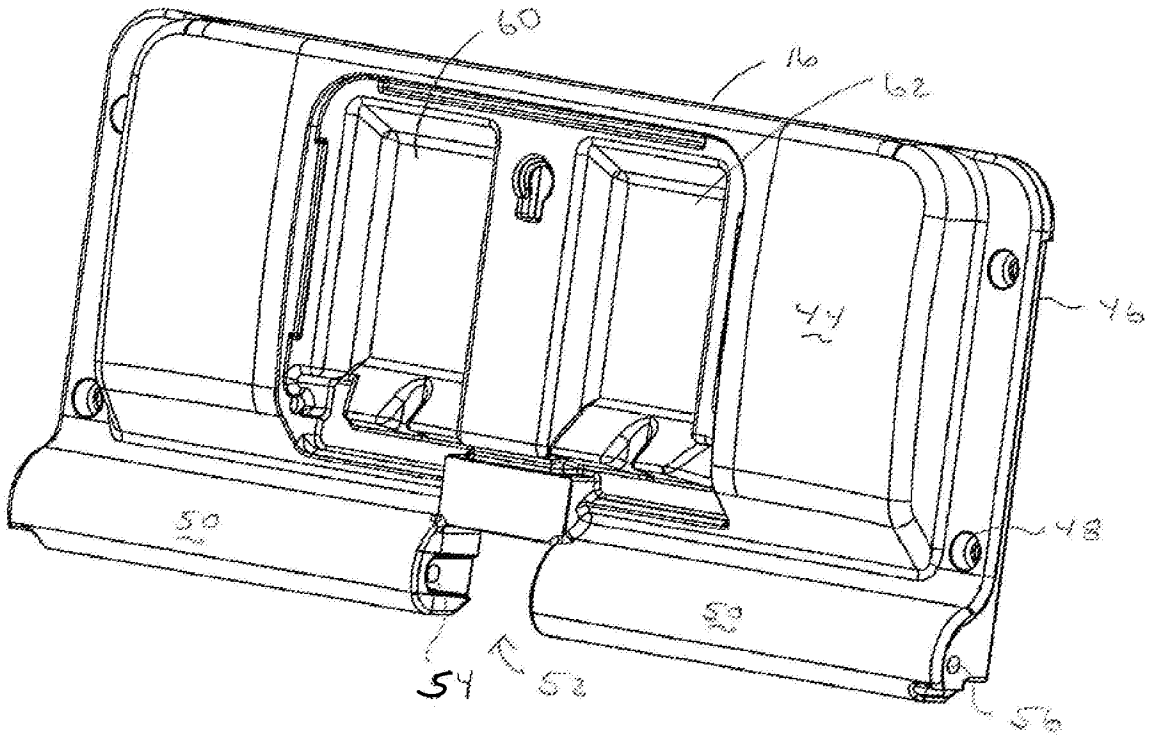
FIG. 12 is a lower right perspective view of the base.
Figure 13:
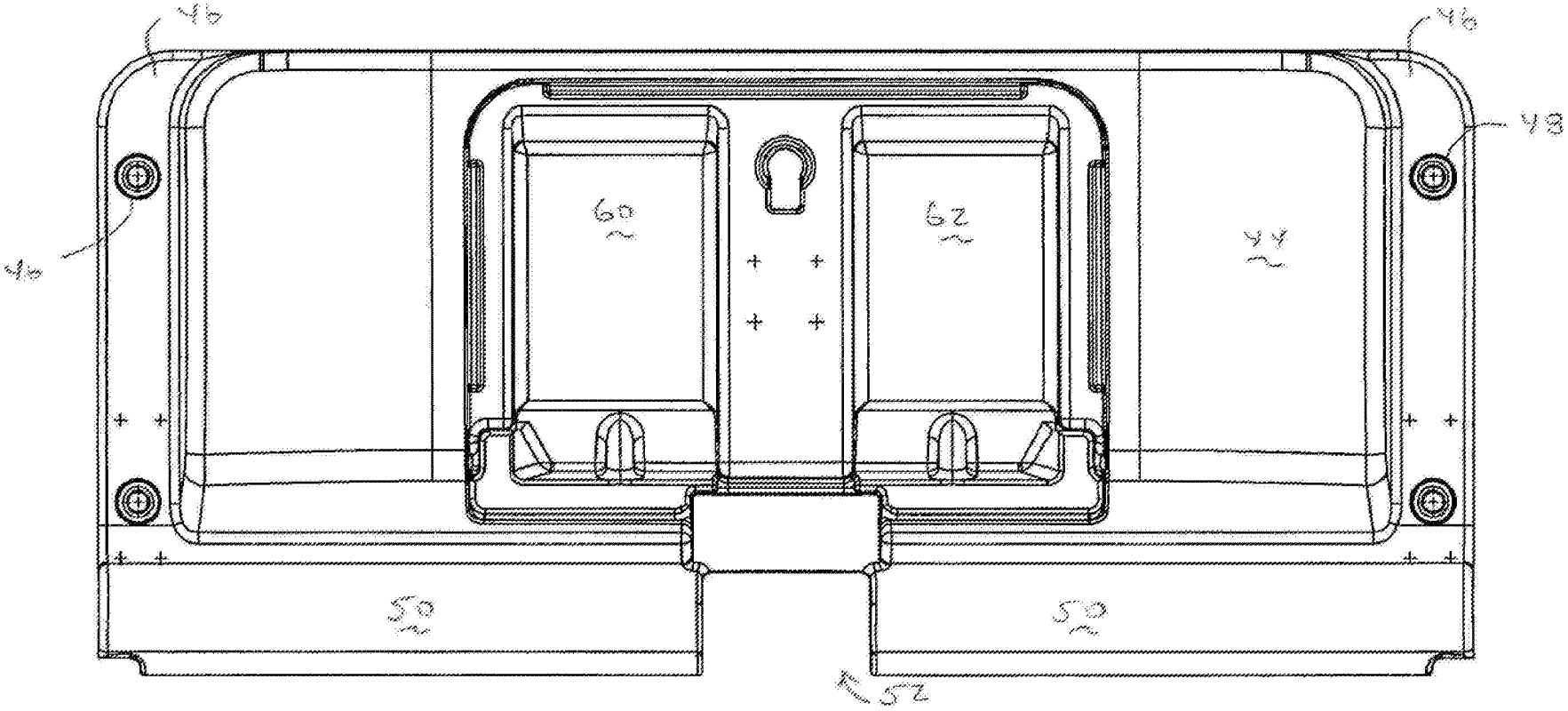
FIG. 13 is a front plan view of the base.

The gap 52 is sized for accepting the bearing block 36 therein in relatively rotatably movable connection. The forward projecting portions 50 each include openings 54 and 56 therein as shown in FIG. 11. Openings 54 and 56 are aligned with openings 38, 40 and 42 to enable and axle shaft to extend therein in the manner later discussed. As shown in FIG. 2 with the changing station in the use position, the forward projecting portions 50 upwardly bound the changing surface 18 at the inward side adjacent to the base 16.

Figure 35:
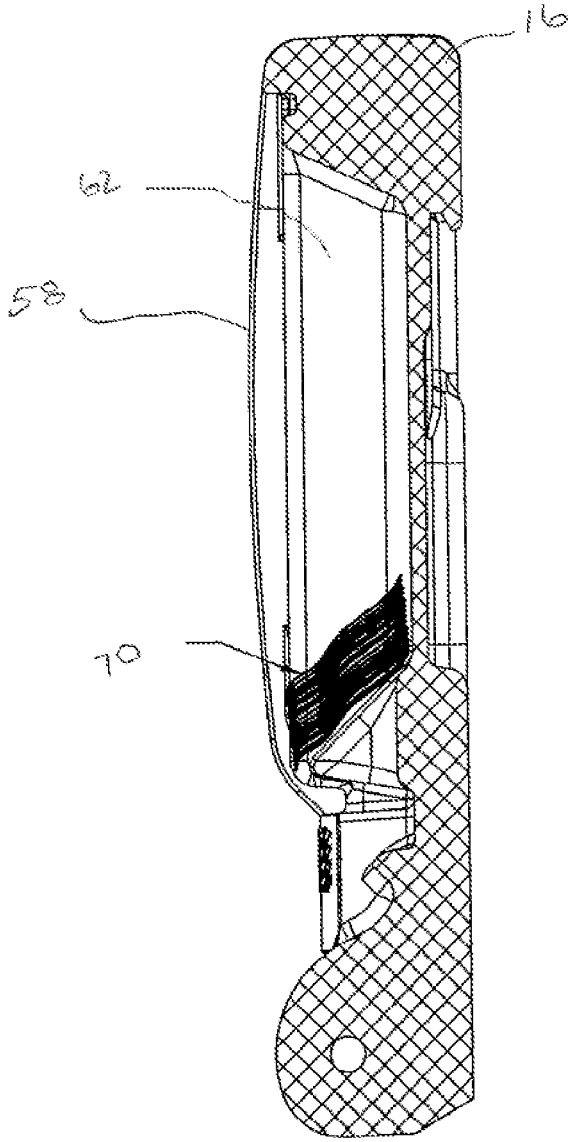
FIG. 35 is a transverse cross-sectional view of the base along line 35-35 in FIG. 34.
Figure 36:
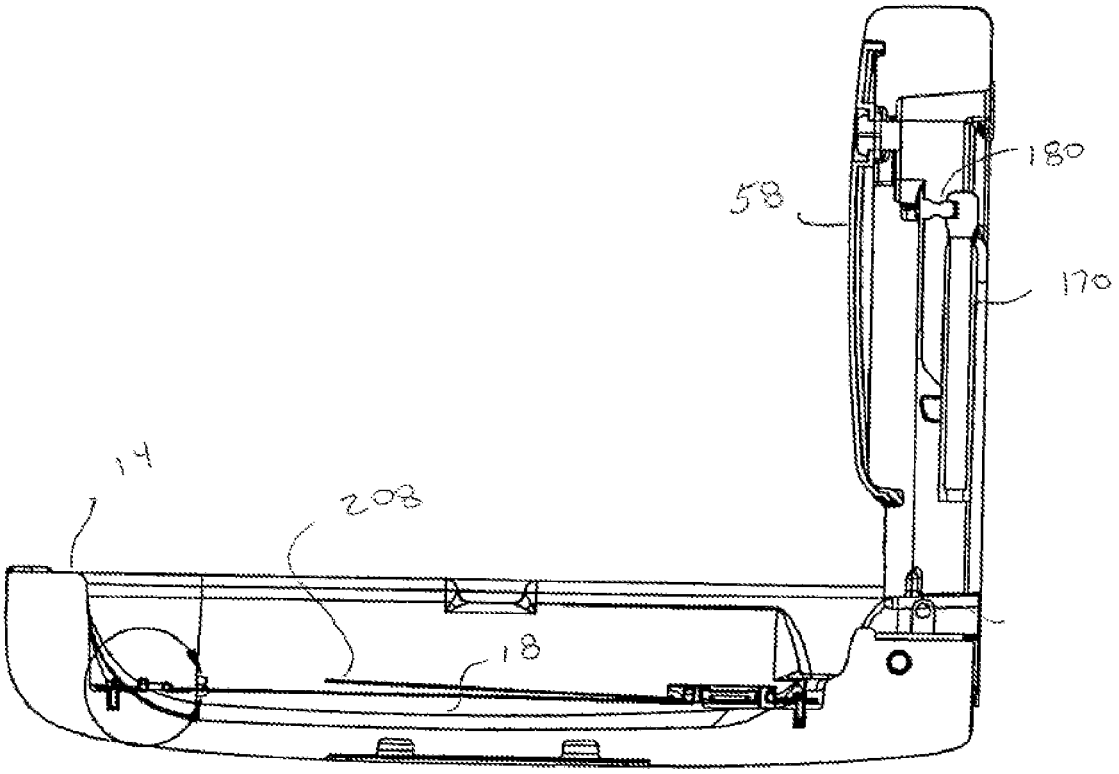
FIG. 36 is a right side transparent view of the baby diaper changing station in a use position and showing the exemplary holding strap assembly arrangement.
Figure 38:
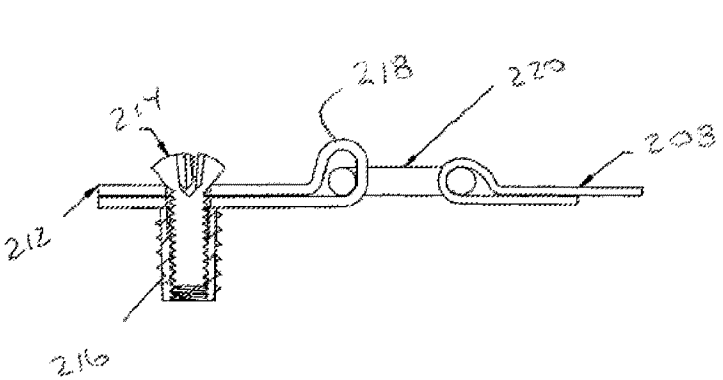
FIG. 38 is a transverse cross-sectional view of the mounting structures at one end of the strap assembly.
Figure 37:
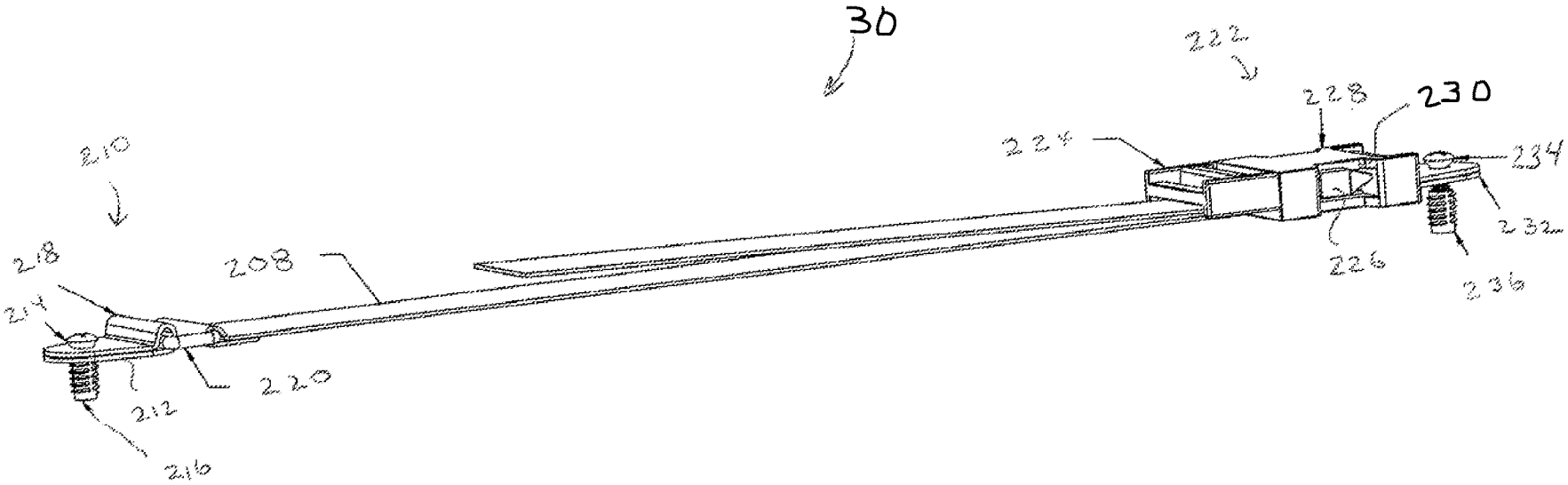

The exemplary base 16 further includes a removable cover 58. The cover 58 is configured to overlie a pair of storage compartments 60, 62 that extend in the central portion 44. The cover 58 is releasably secured by a lock 64 in the exemplary arrangement. Storage compartments 60 and 62 are connected to respective slots 66, 68 at the lower end thereof. As later discussed, disposable liners that can be placed on the changing surface 18 are stored in the storage compartments 60, 62 and can be removed one at a time by users of the changing station through the slots 66, 68 when the cover 58 is in position. FIGS. 34 and 35 show a stack of liners 70 which are positioned in the storage compartment 62. Of course it should be understood that this configuration is exemplary and other arrangements other approaches may be used.

In the exemplary arrangement the base 16 is comprised of molded plastic material similar to the table 14. Further the base is configured so that the table extends in outwardly overlying relation of the base 16 when the table is in the stored position. In the stored position of the exemplary arrangement the central portion 44 of the base extends within the recess of the table that is bounded by the rim 26. This provides for the exemplary changing station to be compact and to extend only a relatively small distance from the wall 12 when in the stored position. Of course this construction is exemplary and in other arrangements other approaches may be used.

Figure 14:
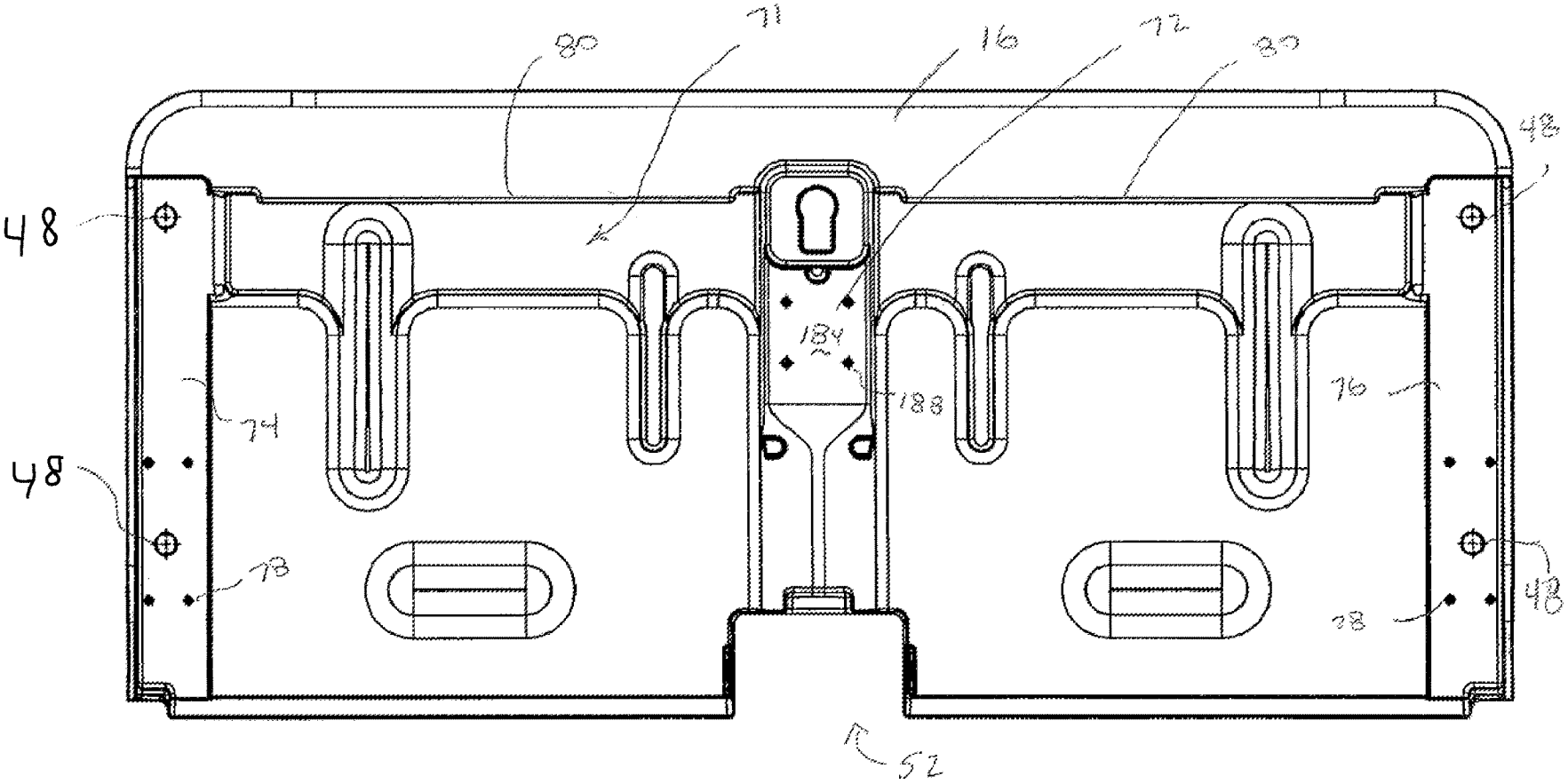
FIG. 14 is a back view of the base.
Figure 15:
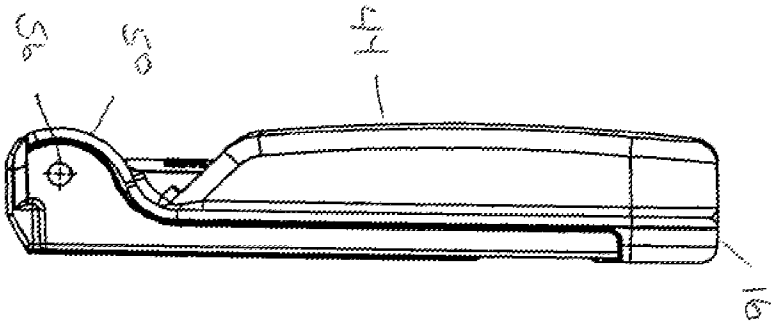
FIG. 15 is a right side view of the base.

FIG. 14 shows the back side of the exemplary base 16. The back of the exemplary base includes a back surface 71. The back surface 71 includes a central recess 72. The central recess 72 extends in substantially aligned relation with the gap 52. As used herein substantially aligned means that there is at least some transverse overlap between the area of the central recess and the gap. The central recess 72 is operative to hold components of a spring assembly which are later discussed in detail. The back surface 71 of the base further includes a rectangular side recess 74 at a first transverse side of the base 16 and a rectangular recess 76 at an opposed transverse side of the base surface 71. The openings 48 are used for mounting anchors that extend in the recesses.

Fastener openings 78 also extend into the base surface within the recess for purposes of mounting the base brackets thereto as later discussed. The exemplary base surface further includes on the rear wall, an edge surface 80. The edge surface 80 extends on both transverse sides of the central recess 72. The edge surface also overlies a horizontal recess 258 that extends below and underlies the edge surface (see FIG. 41). The edge surface 80 extends downward in the operative position and is used in mounting of the changing station to a wall or other supporting structure in a manner that is later discussed. Of course it should be understood that this arrangement is exemplary and other configurations may be used.

Figure 26:
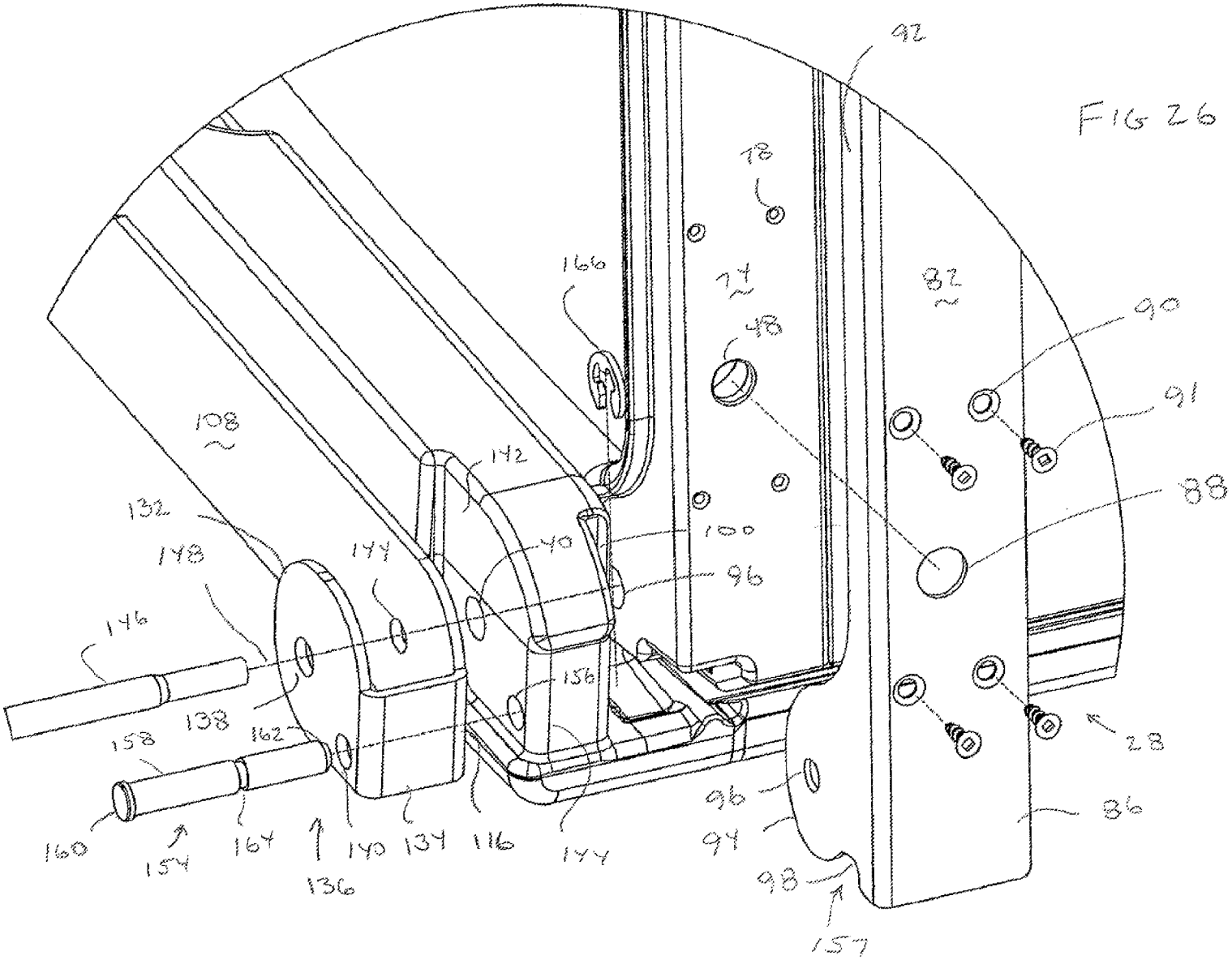
FIG. 26 is an exploded view showing the table and a channel therein, a rail, a clevis and a bridge piece, the base, the base bracket, an axle shaft portion and a stop pin.
Figure 27:
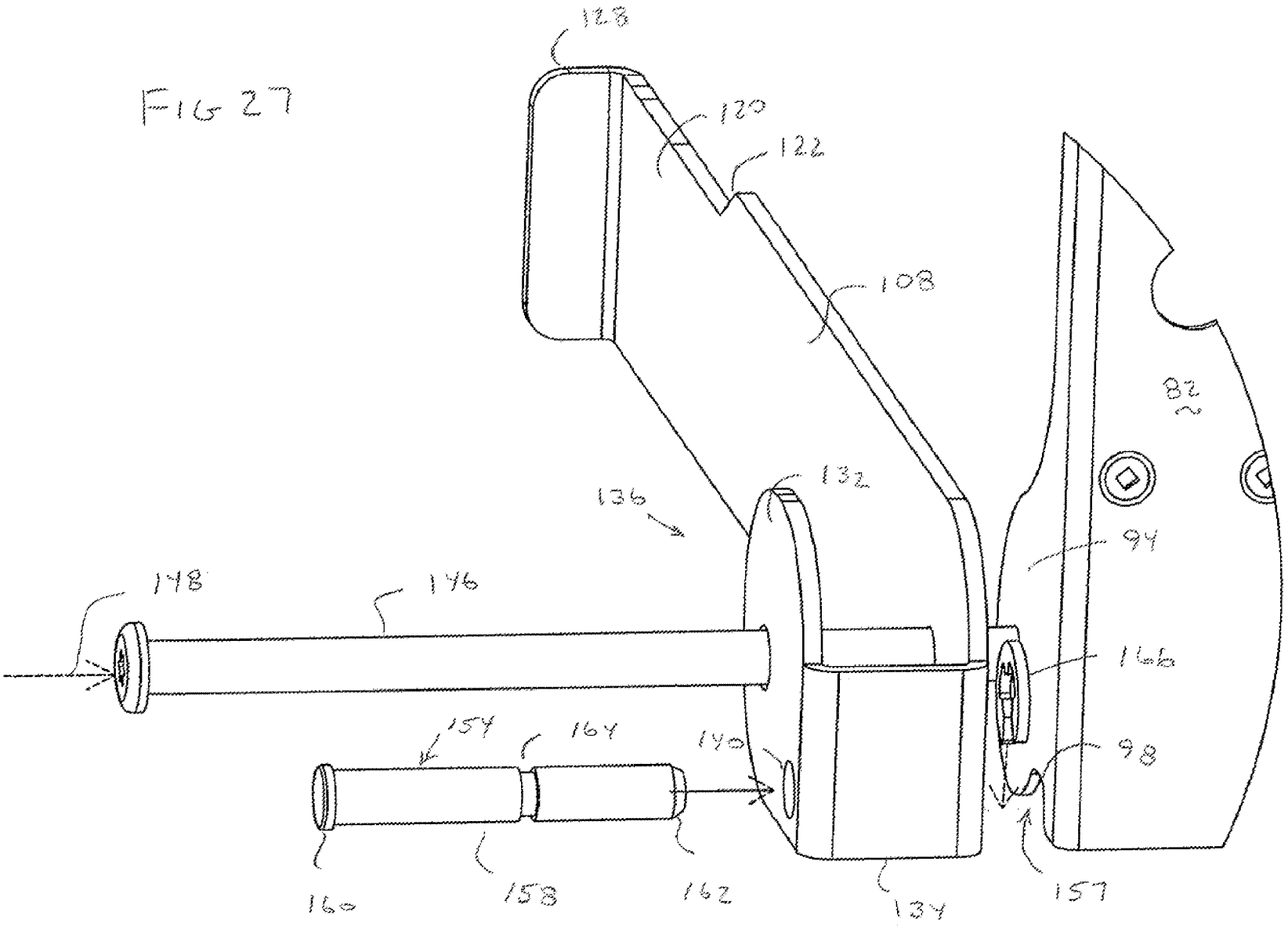
FIG. 27 is a view similar to FIG. 26 but with the table and base structures not shown.
Figure 28:
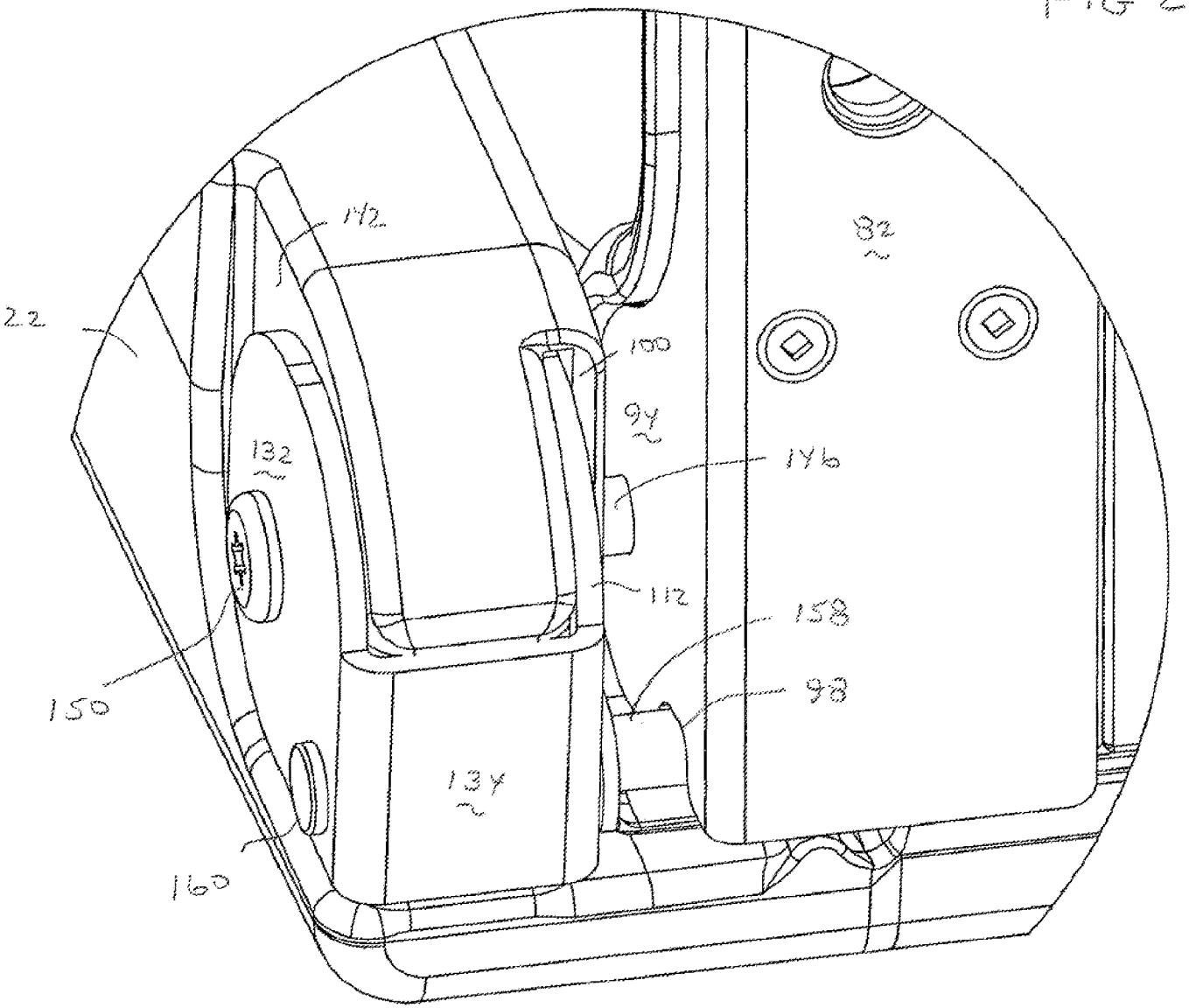
FIG. 28 is a back upper right perspective view showing the table, the base, the base bracket and the rail, the clevis and the bridge piece in an assembled condition.
Figure 29:
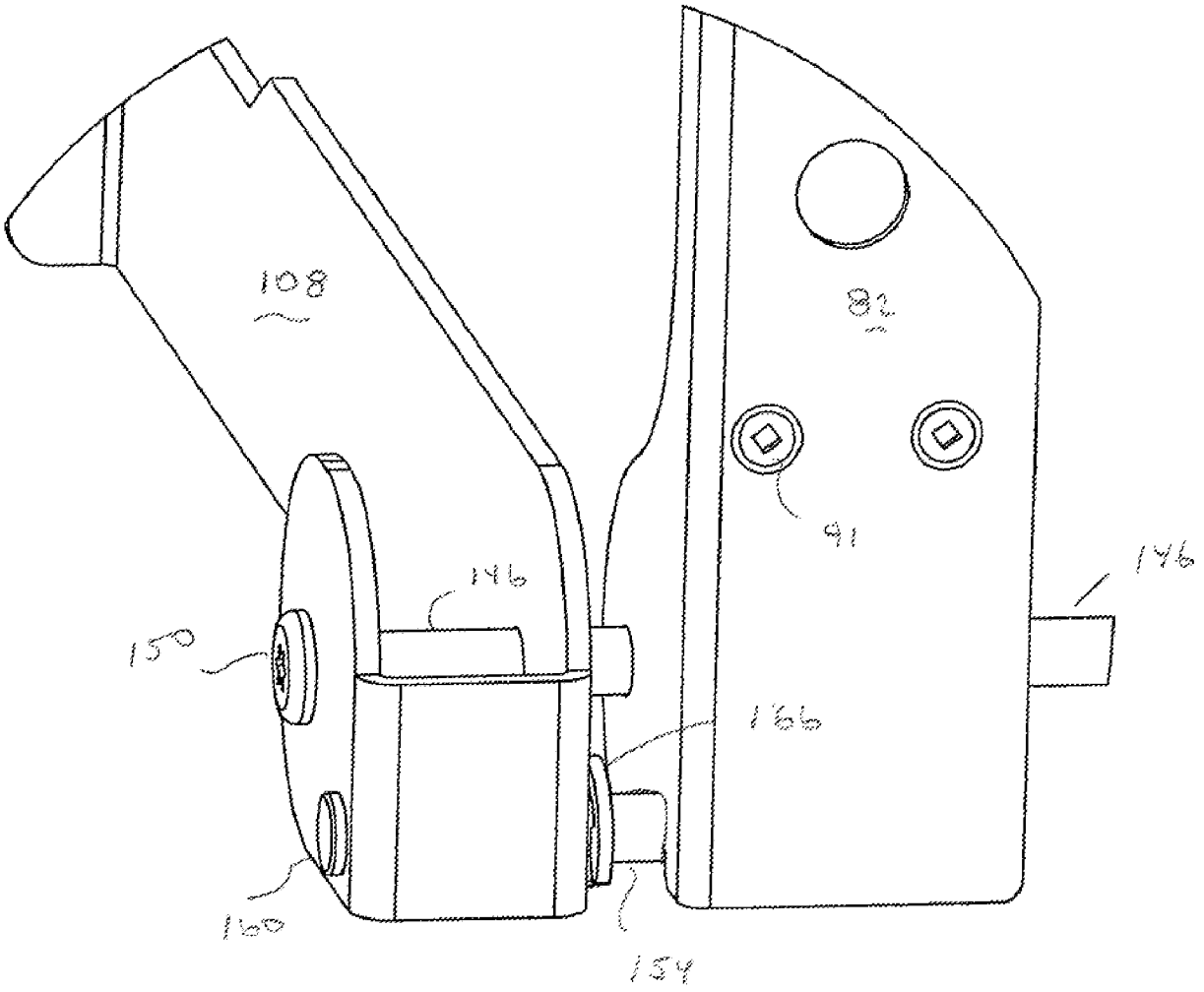
FIG. 29 is a view similar to FIG. 28 except with the table and base structures not shown.

A base bracket 82 extends in side recess 74. A base bracket 84 which is a mirror image of base bracket 82 extends in side recess 76. Each base bracket is generally L-shaped in transverse cross-section which for purposes hereof means that the legs of the bracket extend substantially perpendicular to one another. Each bracket includes a back leg 86. The back leg extends substantially parallel to the wall 12 in the mounted position of the base 16. As used herein substantially or generally parallel will be deemed to mean parallel plus or minus 20°. Each back leg includes openings 88 that are in alignment with openings 48 through which the anchors extend. The back legs further include fastener accepting openings 90. The fastener accepting openings 90 are aligned with the openings 78 in the base. As shown in FIG. 26, fasteners such as screws 91 are used to hold each base bracket in engagement with the base.

Each base bracket further includes a forward leg 92. Each forward leg extends substantially perpendicular to the respective back leg of the base bracket. Each forward leg includes an ear 94. Each ear extends substantially normal to the wall in the operative position of the changing station. Each ear 94 includes an outwardly curved contour that includes an opening 96 therein. The opening 96 in each ear 94 is in aligned relation with a respective opening 56 in the forward projecting portion 50 of the base. Each opening 96 is further configured to have a portion of the axle shaft extend therethrough. Each exemplary forward leg 92 includes a curved recess 157 that is bounded be a stop surface 98 thereon. In the exemplary arrangement the stop surface 98 is configured to engage a stop pin that is in operative connection with the table 14. The engagement of the stop pin and the stop surface 98 is operative to hold the table in the use position, and to prevent the table from rotating downward beyond the use position in a manner that is later discussed. Of course it should be understood that this configuration is exemplary and in other arrangements other approaches may be used.

The exemplary table 14 includes a pair of transversely disposed linearly straight channels 100, 102 therein. Each channel extends within the interior of the rim 26. Channel 100 extends transversely inwardly and substantially parallel to side wall surface 22, while channel 102 extends transversely inwardly and substantially parallel to side wall surface 20. Channel 100 extends from a channel opening 104 in the inner end surface 28 at one transverse side of the table 14. Channel 102 extends from a channel opening 106 at an opposed transverse side of the inner end surface.

Each channel opening is configured to receive a rail therein. Channel 100 receives a rail 108 while channel 102 receives a rail 110. In the exemplary arrangement the rails 108, 110 are mirror images of each other. As the rails are mirror images, only rail 108 will be described in detail. The details of each of rails 108 and 110 will be referred to using the same reference numerals except as otherwise noted.

Figure 23:
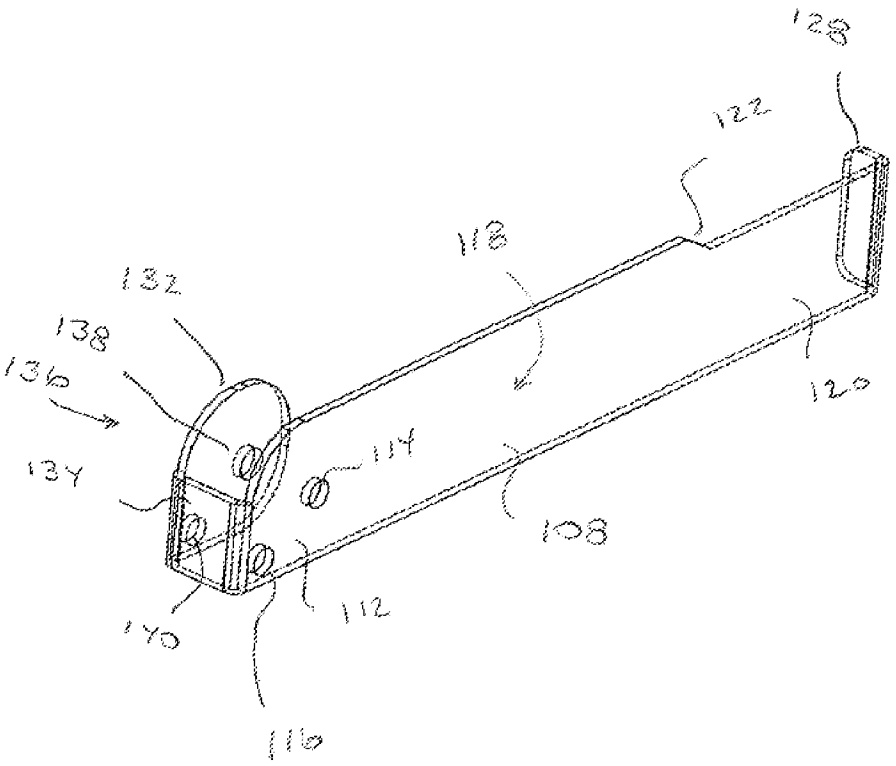
FIG. 23 is an upper left back perspective view of an exemplary rail, clevis and bridge piece.
Figure 24:
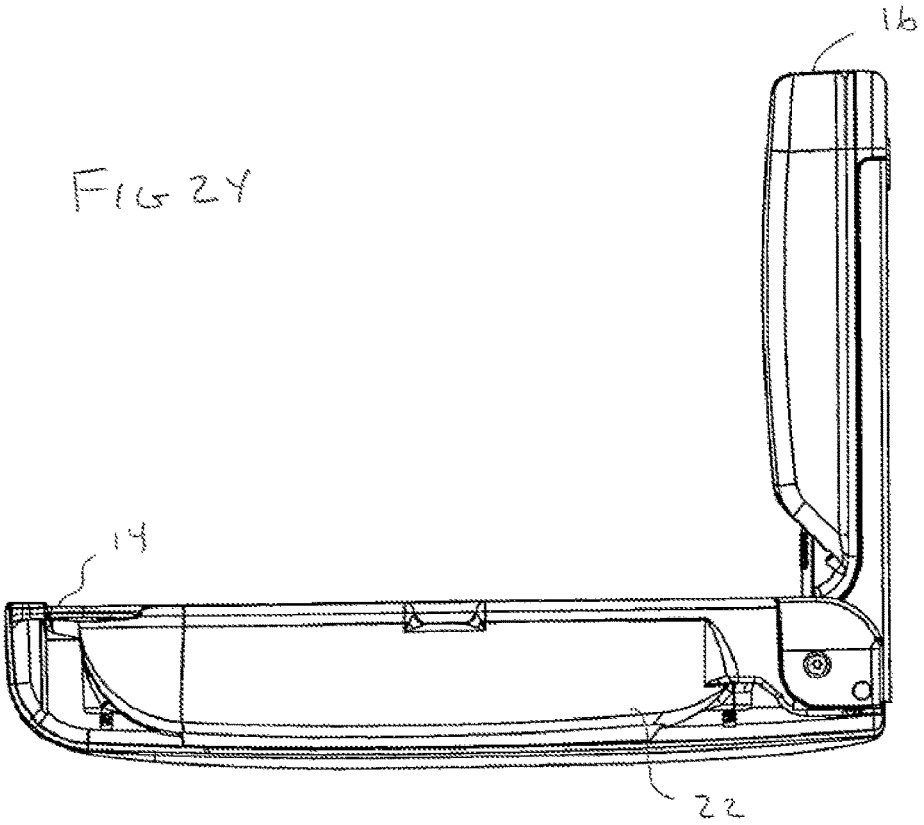
FIG. 24 is a right side view of the exemplary baby changing station in a use position.

As shown in FIG. 23 the exemplary rail 108 includes a rail end 112. When the rail is positioned in the operative position within the respective channel, the rail end is proximate to the respective channel opening and is accessible from the outside of the table. The exemplary rail end 112 of rail 108 includes a shaft opening 114 and a stop pin opening 116. The shaft opening 114 is aligned with the opening 96 of an adjacent ear 94 of an immediately adjacent base bracket. The shaft opening 114 is configured to receive an axle shaft portion therein and to rotate about an axis 148 when the unit is in the operative assembled condition as later discussed.

Figure 21:
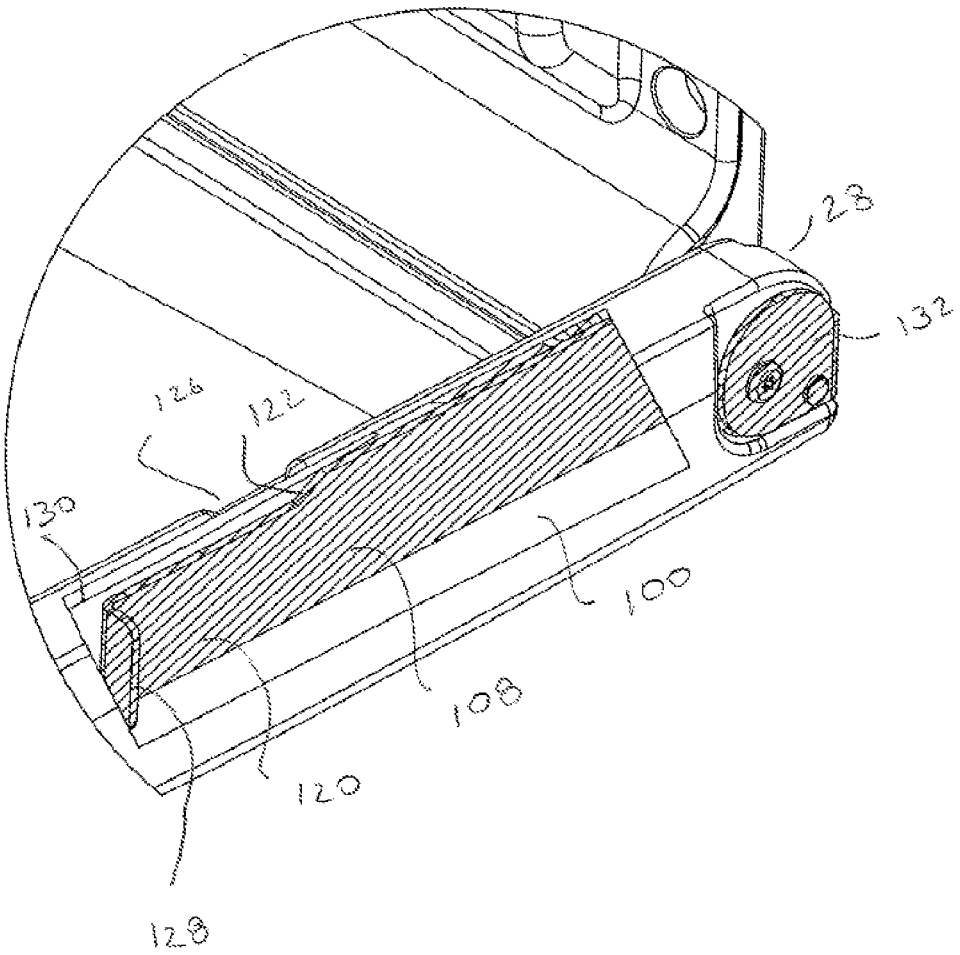
FIG. 21 is an enlarged partial cutaway perspective view of a side of the table showing a rail in a channel that extends in the channel.

The exemplary rail 108 includes an elongated plate 118. The elongated plate 118 is configured to extend within the respective channel substantially perpendicular to the axis and substantially parallel to the outwardly overlying side wall. In the case of rail 108 the elongated plate extends in channel 100 substantially parallel to side wall surface 22. This is shown for example in FIGS. 21 and 22. The exemplary rail 108 further includes a reduced area 120. The reduced area extends at an end of the rail that is disposed inwardly from the rail end 112. The reduced area 120 is reduced in at least one dimension relative to the rail end. In the exemplary arrangement the reduced area is reduced in a height dimension relative to the rail end. A tapered step engagement surface 122 provides the dimensional transition from the outer portion of the rail which includes the rail end to the reduced area 120.

Figure 22:
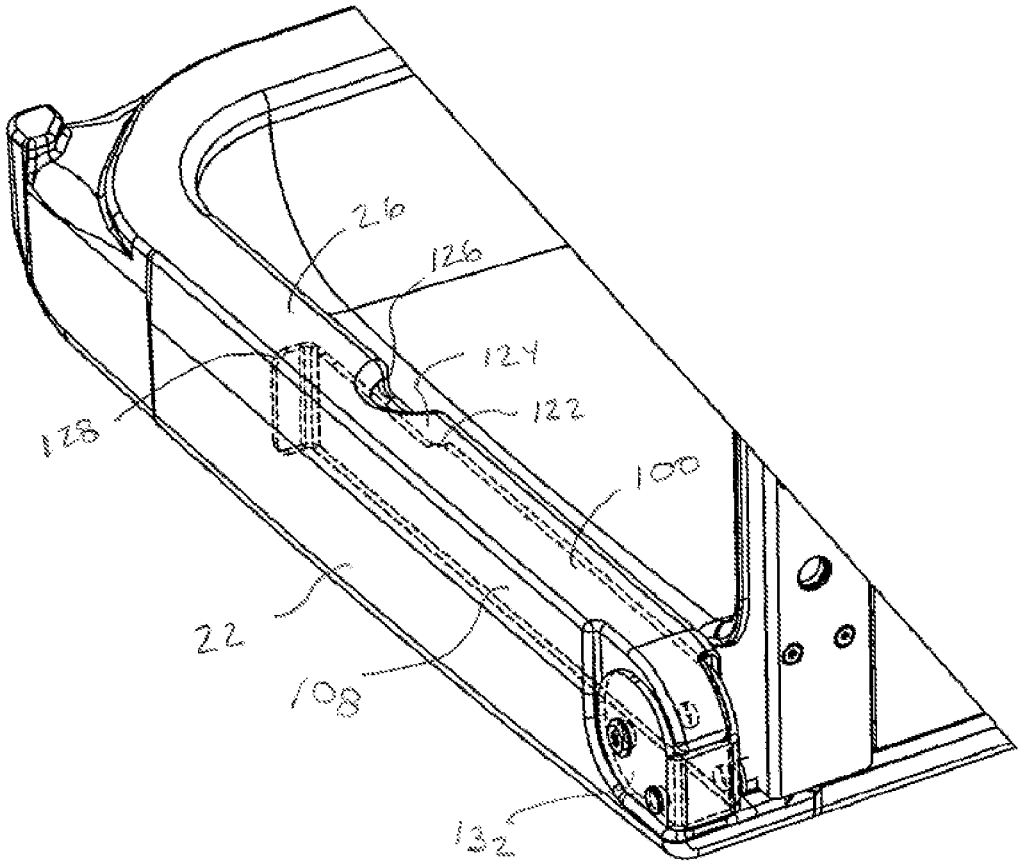
FIG. 22 is a rear right top perspective view showing in phantom a rail extending in a channel of the table.

In the exemplary arrangement the respective channel in which the rail extends includes an internal step 124. As shown in FIG. 22 the internal step 124 underlies a side recess 126 that extends inwardly in the rim 26. The step engagement surface 122 of the rail engages the internal step 124 within the channel 100. The engagement of the internal step 124 and the step engagement surface 122 helps to maintain engagement of the table and the respective rail within the channel. It also helps to assure proper positioning of the rail within the respective channel. Of course it should be understood that this approach is exemplary and in other arrangements other approaches may be used.

Figure 25:
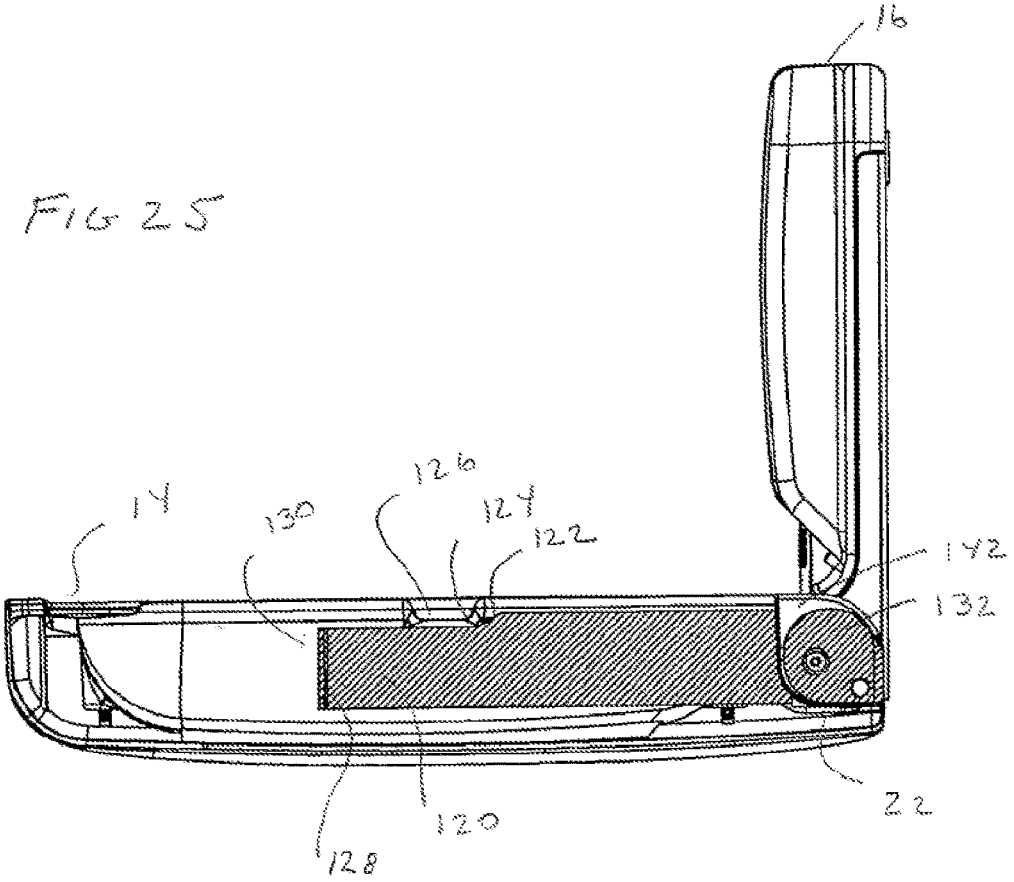
FIG. 25 is a view similar to FIG. 24 but with the side of the table partially cutaway to show a rail extending in a channel therein.

In the exemplary rail configuration the reduced portion 120 terminates inwardly within the respective channel at a turned inside end 128. The turned inside end 128 extends substantially perpendicular to the reduced area 120 of the elongated plate 118. The turned inside end 128 also extends substantially perpendicular to the side wall surface 22 that is in immediately adjacent relation with the channel 100. In the exemplary arrangement the channel 100 in which the respective rail 108 extends is bounded inwardly from the channel opening 104 within the rim by a channel end generally indicated 130 (see FIG. 25). In the exemplary arrangement the channel end 130 is at least halfway from the inner end surface 28 of the table to the outer end surface 24. In exemplary arrangements the channel end 130 is the furthest inward point within the channel into which the respective rail extends. In some exemplary arrangements the inward channel end 130 is an area within the interior of the rim 26 which is reduced in size, curved or otherwise constricted so that each substantially linearly extending straight rail cannot extend further inwardly in the table from the inner end surface. As used herein the term substantially linearly extending means that a majority of the element may extend along or about a straight line. In some exemplary arrangements the channel end 130 may include one or more walls, projections or other structures that are configured to engage the rail at the turned inside end 128 thereof. Such structures may provide further points of contact for solid engagement between the table and the rail, and also serve to position the rail within the channel. Of course these approaches are exemplary and other arrangements other approaches may be used.

The exemplary rail 108 is attached to an outboard end 132. The outboard end is attached to the respective rail end 112 by a bridge piece 134. This arrangement produces a clevis generally indicated 136. The outboard end 132 is disposed transversely outwardly from the rail end 112 and extends substantially parallel thereto. The outboard end 132 includes an opening 138 that is axially aligned with shaft opening 114 in the rail end and is configured for receiving an outboard portion of the axle shaft therethrough. The outboard end 132 further includes a stop pin opening 140 therethrough. The stop pin opening 140 is aligned with stop pin opening 116 in the rail end. In the exemplary arrangement in the operative position of the changing table, each outboard end 132 outwardly overlies the immediately adjacent side wall surface of the table 14. In the case of rail 108 the outboard end 132 transversely overlies side wall surface 22. In the exemplary arrangement each side wall surface includes a recess 142 in which the outboard end 132 extends. In the exemplary arrangement side wall surface 20 also includes a similar recess 142 which receives the outboard end 132 of rail 110.

Figure 20:
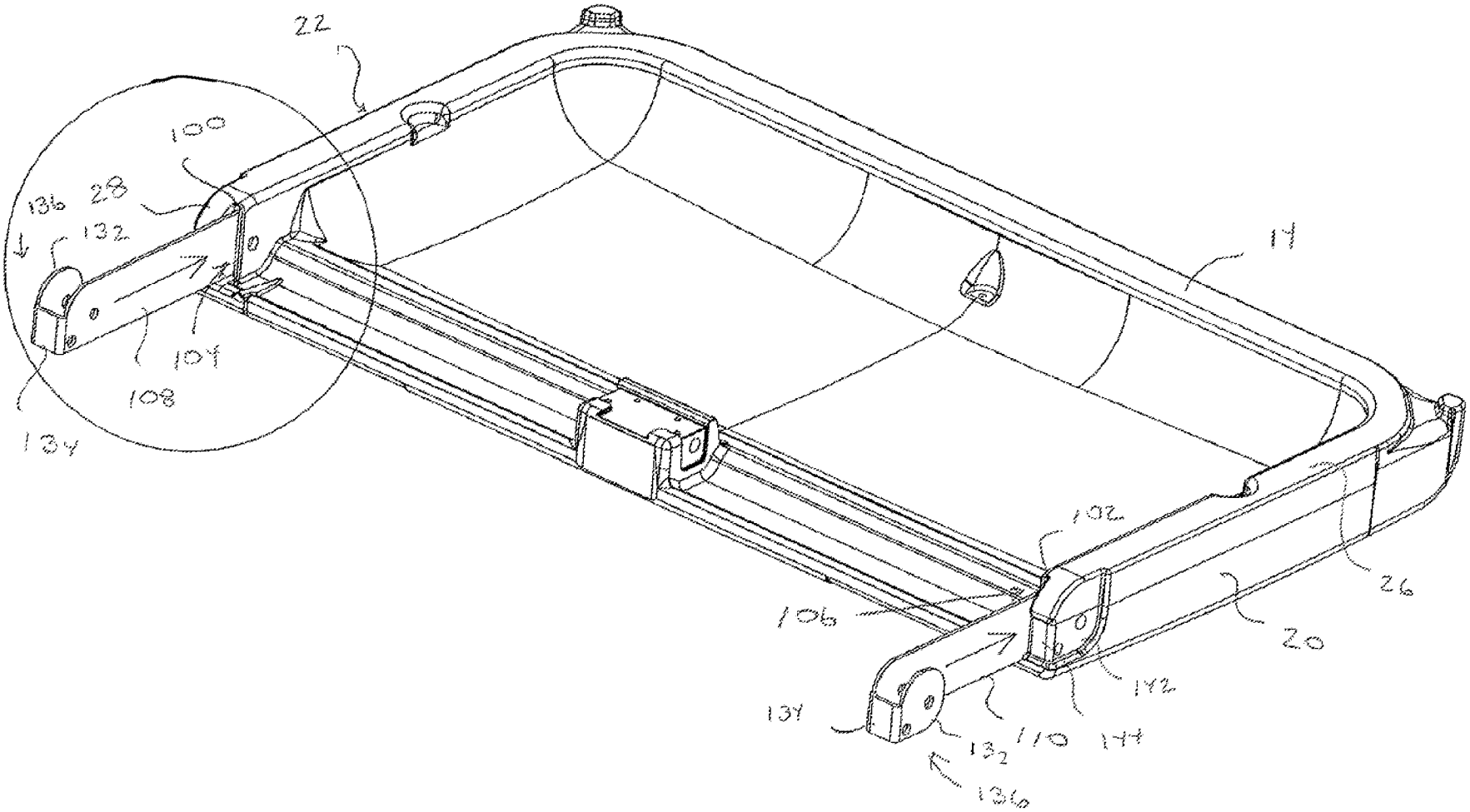
FIG. 20 is a rear top perspective view of the table showing exemplary rail structures being extended into respective straight linear channels within the table.

The inboard end 28 of the table 14 includes on each respective transverse side a recessed notch 144. Each notch 144 extends substantially parallel to the axis 148 and transversely between the immediately adjacent channel opening 104 or 106 and the immediately adjacent side wall surface 22 or 20. Each recessed notch 144 is configured to receive therein in nested relation a respective bridge piece 134 which also extends substantially parallel to the axis. This configuration of the exemplary arrangement further helps to assure that the rails 108 and 110 and the outboard ends 132 are in operatively fixed engagement with the table. As represented in FIG. 20, when the rails are inserted in the respective channels during assembly of the changing station, the bridge portions 134 fully nest within the respective recessed notch 144 at each lateral side of the inner end surface. This exemplary construction further helps to position the openings for the axle and the stop pins in alignment when the table is assembled. Of course this approach is exemplary and in other arrangements other approaches may be used.

Figure 16:
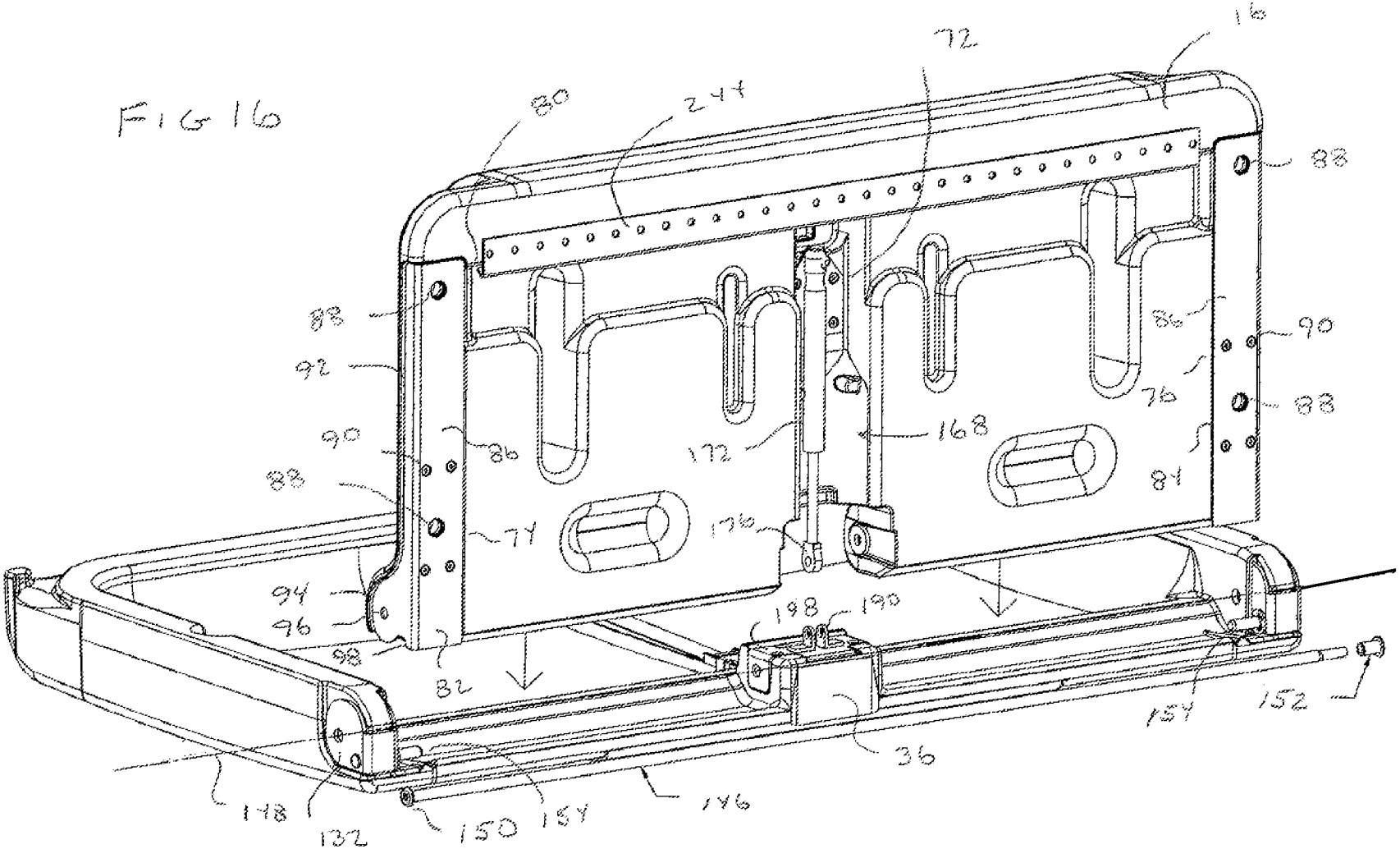
FIG. 16 is a rear partially exploded view of the baby diaper changing station including the base and the table.
Figure 17:
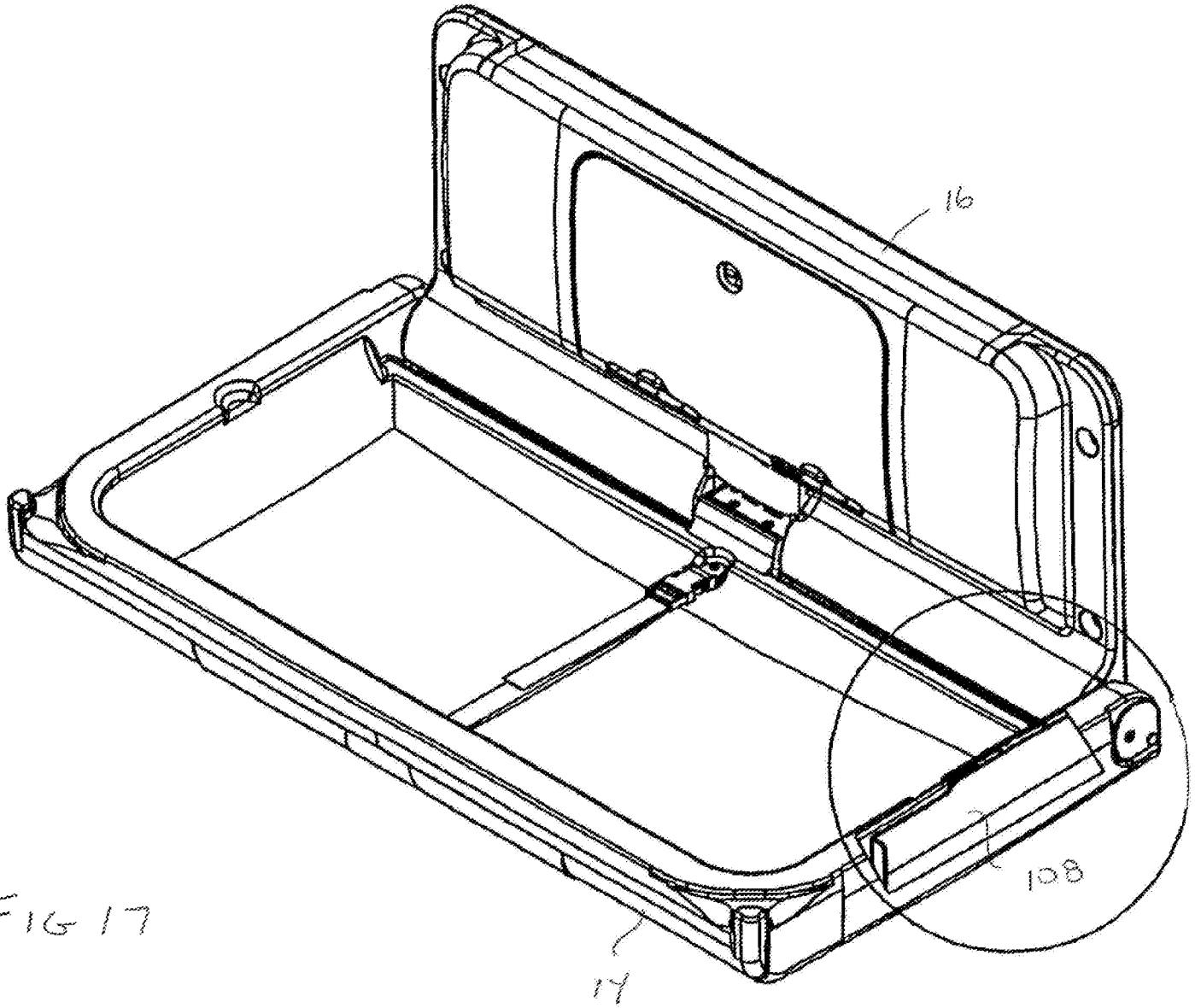
FIG. 17 is a front upper right perspective view of the baby diaper changing station in a use position with a portion of a circled area partially cutaway.
Figure 18:
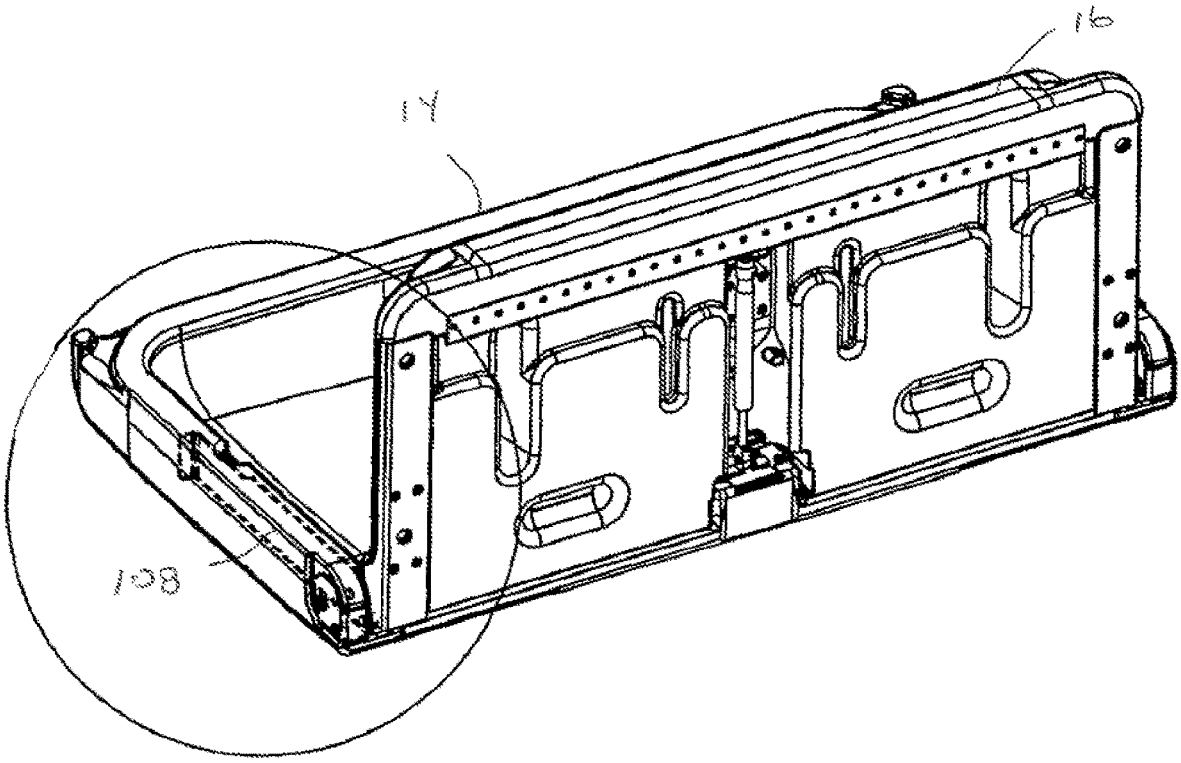
FIG. 18 is a top right rear perspective view of the baby diaper changing station in a use position and showing through hidden edge lines a support rail that extends within the table.
Figure 19:
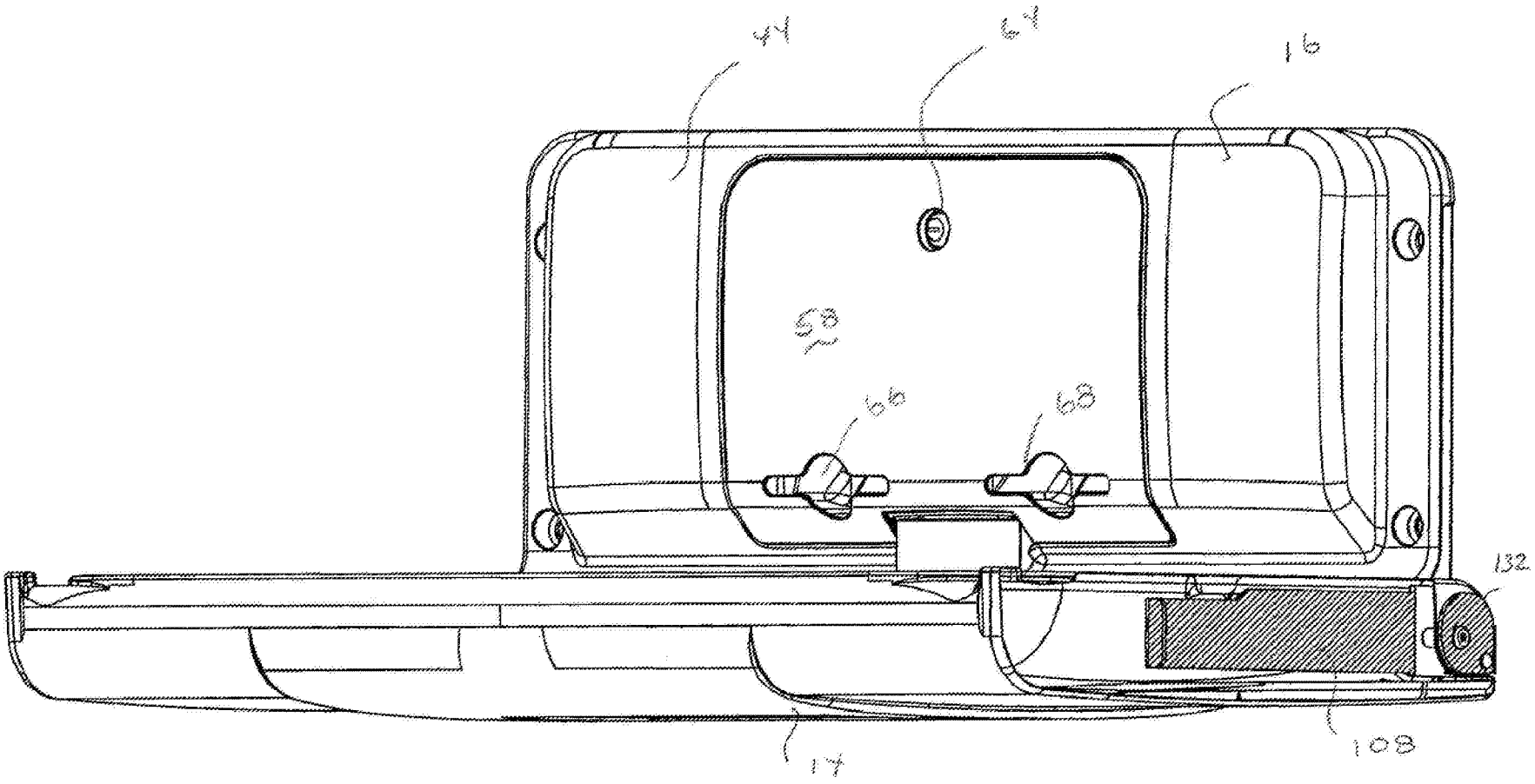
FIG. 19 is a front right perspective view of the baby diaper changing station with a portion of the table structure partially cutaway.

As represented in FIGS. 16 and 26 an axle shaft 146 extends through the aligned openings in the table and the base along an axis 148. In the installed position the axle shaft 146 extends through each clevis 136 associated with rails 108, 110 as well as the opening 96 in each ear 94 of base brackets 82, 84. In the installed position the axle shaft 146 also extends through the openings 38 in the bearing block 36, the openings 54, 56 in the forward projecting portion 50 of the base, and the openings 40, 42 at the inner end surface 28 of the table. This enables the table 14 to rotate about the axis 148 between the use position and the stored position. In the exemplary arrangement the axle shaft 146 when installed is maintained in position by an enlarged head 150 at one transverse end that engages one outboard end 132, and a retaining nut 152 which is positioned at the opposed transverse end of shaft 146 and engages the other outboard end 132. Of course this arrangement is exemplary and other embodiments other arrangements may be used.

In the exemplary arrangement stop pins 154 extend through each clevis 136 and are radially disposed from and substantially parallel to the axis 148. The stop pins operate to limit the rotational movement of the table relative to the base to the use position at which the table extends substantially normal to the base and the wall. In the exemplary arrangement the stop pins are configured to deform in the event that an excessive vertical load is applied to the table beyond what should reasonably be supported thereon. Normally such an excessive load is associated with attempted vandalism of the changing station. In exemplary arrangements the stop pins deform and are frangible so as to break when an excessive load is encountered. The exemplary arrangement is configured so that if the stop pins are fractured, other components of the unit remain intact. The stop pins can then be readily replaced and the baby diaper changing station returned to service.

In the exemplary arrangement as represented for example in FIG. 26, each stop pin extends through stop pin opening 140 in the outboard end 132 as well as stop pin opening 116 in the rail end 112. The stop pin also extends through aligned stop pin openings 156 adjacent to the inner end surface 28 of the table. Each exemplary stop pin 154 includes an elongated cylindrical body 158. The body extends from a radially enlarged outboard head 162 to a transversely inboard end 162. An annular recess 164 is positioned transversely intermediate of the radially enlarged head 160 and the inboard end 162. A retainer clip 166 is engageable in the recess 164 of the body 158. The engagement of the retainer clip 166 in the recess 164 limits transverse movement of the stop pin. Thus, in the installed position the head 160 of the stop pin is in abutting relation with the respective outboard end 132 of the clevis 136 in which the stop pin is installed.

Figure 30:
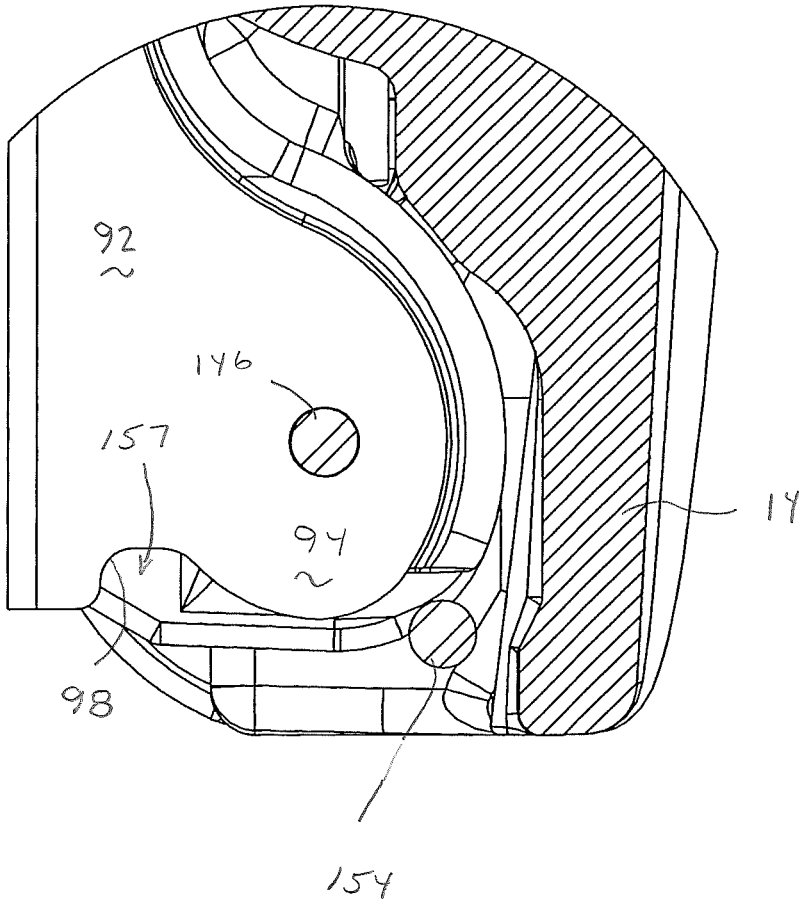
FIG. 30 is a right side partially sectioned view of the table and base in a stored position and with the stop surface on the forward leg of the base bracket disposed from the stop pin.
Figure 31:
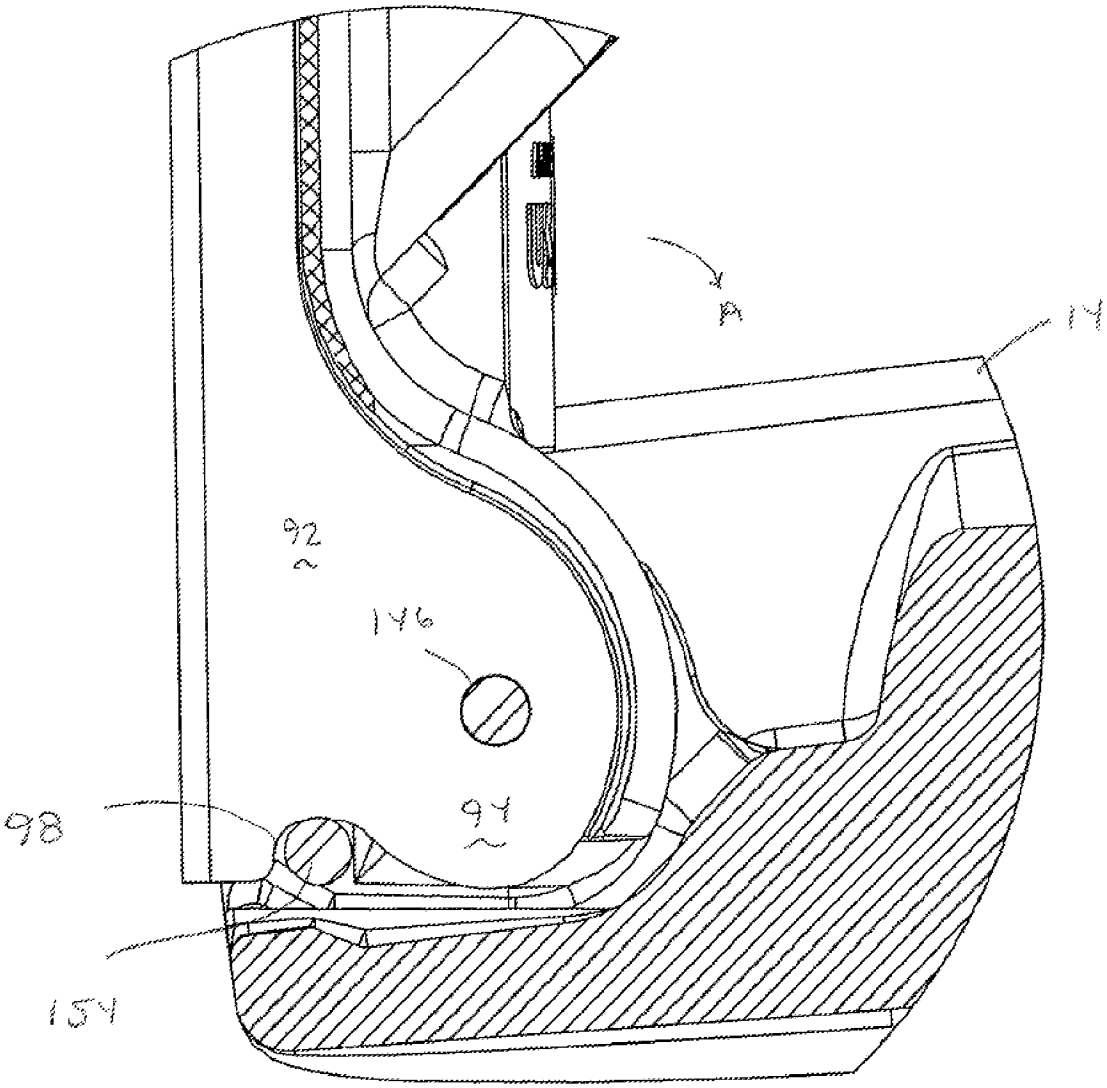
FIG. 31 is a right side partially sectioned view of the table and base in a use position and with the stop surface on the forward leg of the base bracket in engagement with the stop pin.
Figure 32:
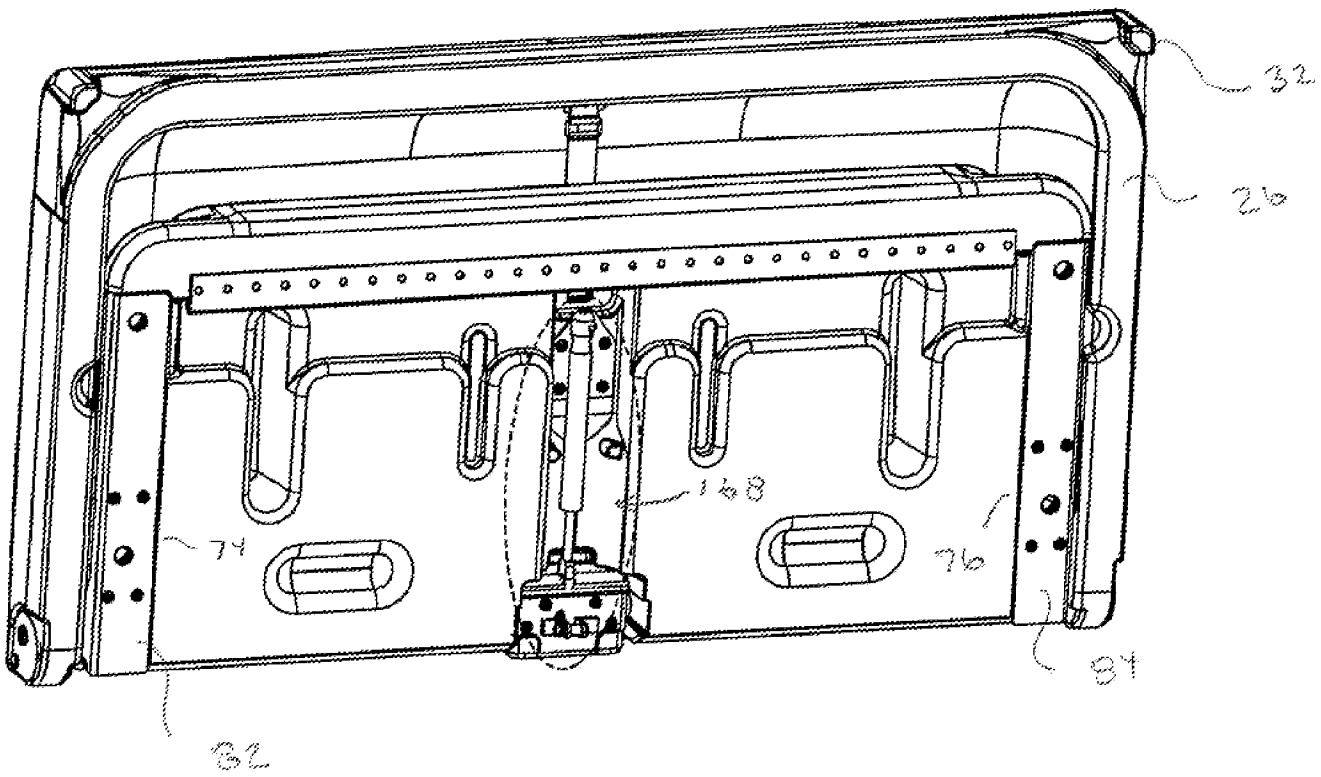
FIG. 32 is a rear view of the baby diaper changing station in a stored position and showing the spring assembly thereof bounded by a broken line.

As represented in FIGS. 30 and 31 the stop pins 154 are operative to limit the rotational movement of the table 14 relative to the base from the stored position to the use position. As shown in FIG. 30, when the table 14 is in the stored position the stop pins 154 are disposed away from the stop surfaces 98 on the forward legs 92 of the base brackets. When the table 14 is rotated to the use position shown in FIG. 31, each of the stop pins 154 extend in curved recesses 157 which are bounded by the stop surfaces 98 on the forward legs 92 of the base brackets. The inboard ends 162 of the stop pins engage the stop surfaces 98. The engagement of the stop pins and the stop surfaces provide more than the normally required supporting force to prevent the table 14 from rotating in the opening direction represented by Arrow A from the stored position beyond a position substantially normal to the base.

In the event that vandalism or other anomalous conditions are encountered which result in the table 14 having applied thereto an excessive downward force above a limit, that acts to move the table in the direction of Arrow A beyond the use position, the stop pins 154 will deform longitudinally intermediate of the stop surfaces 98 and the clevises 136. In the exemplary arrangement the stop pins 154 are configured to be frangible so that deformation causes the pins to separate at the recess 164. Once the stop pins have fractured and separate at the recesses, the table may rotate in the direction of Arrow A beyond the use position without causing damage to other components of the changing station. As a result the exemplary arrangement may be returned to service by replacing the stop pins 154 and the retaining clips 166. Of course it should be understood that this arrangement is exemplary and other arrangements other approaches may be used.

Figure 33:
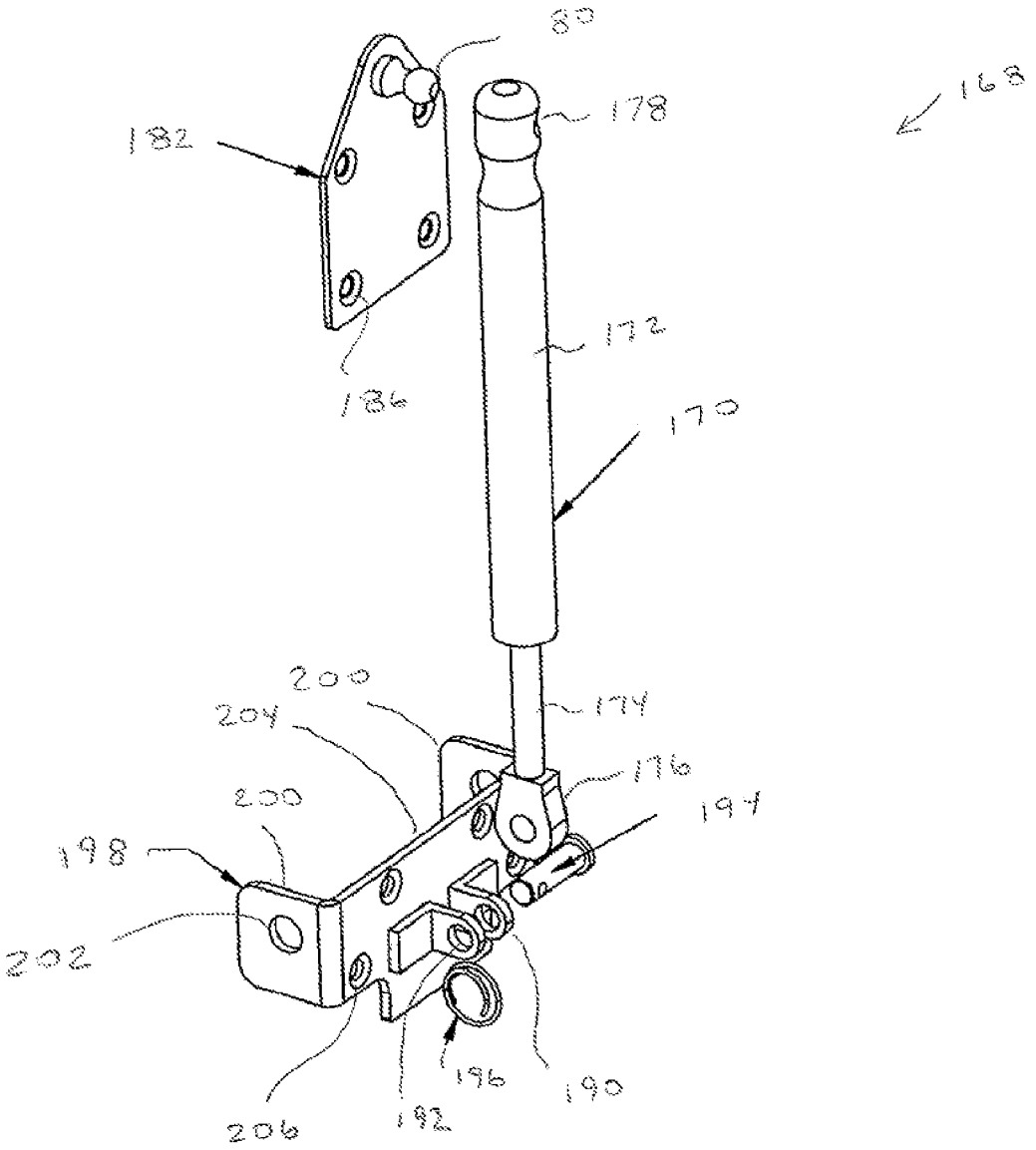
FIG. 33 is an exploded view of the exemplary spring assembly.
Figure 37:
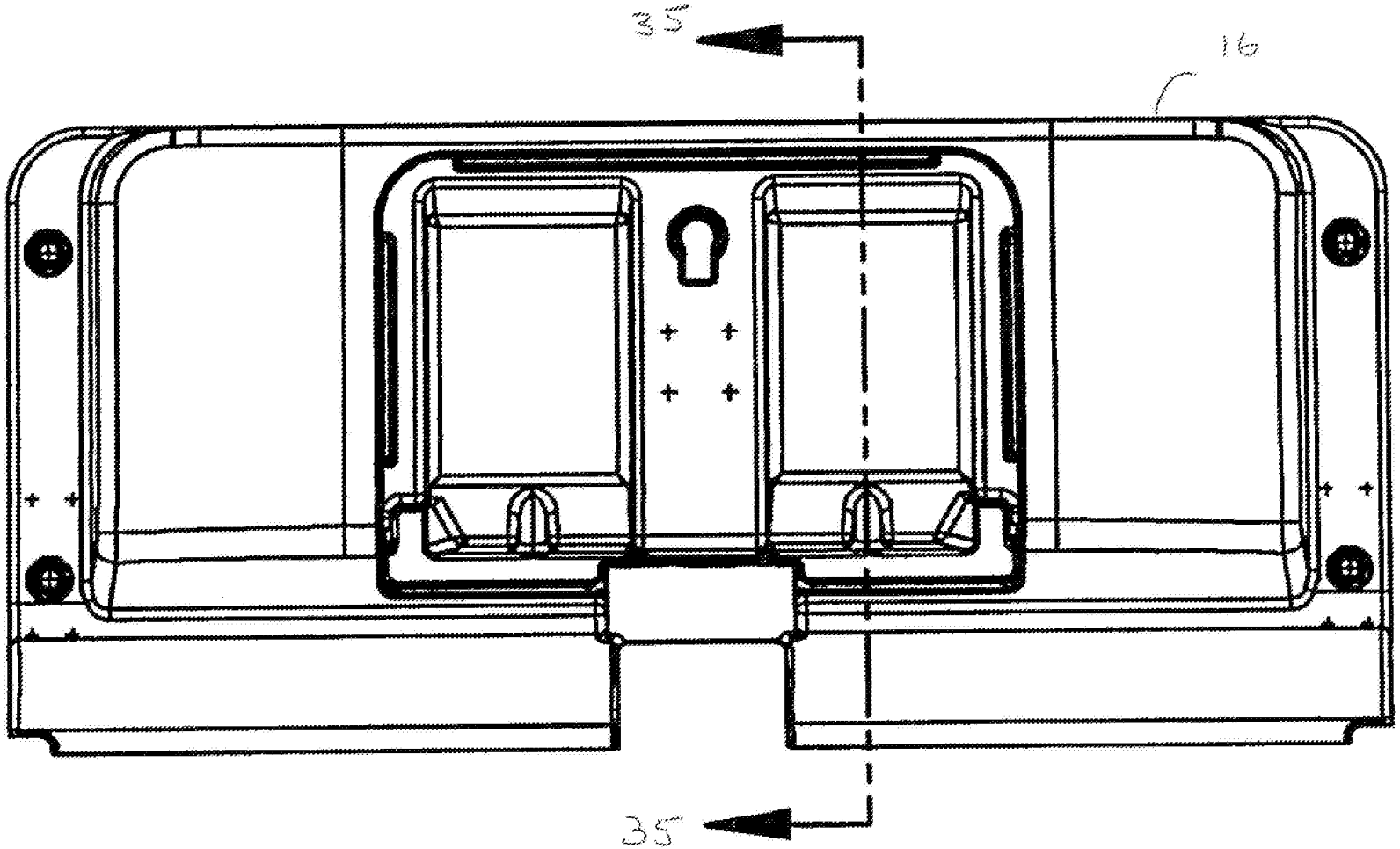
FIG. 37 is a perspective view of the exemplary holding strap assembly.

In the exemplary arrangement a spring assembly generally indicated 168 is operative to assist a user in moving the table from the use position to the stored position. In the exemplary arrangement the spring assembly 168 is positioned in the central recess 72 on the back of the base 16. The spring assembly acts between the base and the table so that when the table is moved toward the stored position the spring assembly will assist in such movement by biasing the table toward the stored position and then maintain the table in the stored position. When it is desired to move the table from the stored position to the use position, the table can be rotated about the axis 146 into the use position. As shown in FIG. 33 the exemplary spring assembly 168 includes an air spring 170. The air spring 170 includes a cylinder portion 172 and an outwardly biased rod portion 174. The rod portion 174 is attached to an end portion 176 at a distal end that includes an opening therethrough. The cylinder portion includes a ball joint which includes an opening 178 that is configured to receive and hold the circular head of a pin 180.

The pin 180 extends outward from a plate 182. The plate 182 is a substantially planar, flat plate that is configured to be attached in overlying relation with a land 184 on the backside of the base in the recess 72 (see FIG. 14). The plate 182 includes a plurality of openings 186. The openings 186 are alignable with openings 188 in the land 184 so that fasteners such as screws may be extended therethrough. The screws or other fasteners are operative to hold the plate 182 in engaged relation with the base 16.

The end portion 176 that is attached to the rod is configured to extend between a pair of disposed ears 190. Each of the ears 190 include an opening 192 therethrough. Each of the openings 192 is sized for receiving a pin 194 therein. A spring retainer 196 is configured to releasably extend through a hole in the pin 194. As a result the pin 194 is enabled to hold the end portion 176 of the rod 174 in engagement with the ears 190.

The ears are attached to a generally C-shaped bracket 198. The bracket includes a disposed pair of end portions 200. Each end portion includes an opening 202 therethrough. The openings 202 are sized to enable the axle shaft 146 to extend therethrough. The bracket 198 further includes a middle portion 204 which extends between the end portions. The middle portion 204 includes a plurality of fastener accepting openings 206 therethrough.

In the exemplary arrangement the bracket 198 is attached to the bearing block 36 of the table. The middle portion 204 of the bracket is fastened to the bearing block through fasteners that extend through the openings 206. The axle shaft 146 extends through the openings 202 in the end portions 200 on each side of the bearing block 36. The end portion 176 which is attached to the distal end of the rod 174 of the air spring is operatively engaged with the ears 190 of the bracket.

Thus as can be appreciated from FIG. 16, when the table 14 is in the use position the force of the air spring 172 acts generally in a direction through the axis 148 of rotation, and does not bias the table toward the closed position. However in the use position the force applied by the air spring does not inhibit a user of the changing station from moving the table from the use position toward stored position. As the table is manually rotated toward the stored position from the use position, the ears 190 on the bracket 198 move rotationally so that the air spring acts in a direction that is further disposed away from the axis 148. As a result the force of the air spring urges the table toward the stored position. FIG. 33 shows the air spring assembly 168 with the bracket 198 in a position that corresponds to the stored position of the table. As can be appreciated, the force of the air spring provides greater torque in the range intermediate of the use position and the stored position urging the table toward the stored position due to the position of the centerline of the ears 190 being radially disposed from the axis 148. Thus in the exemplary arrangement the spring assembly operates to urge the table toward the stored position but enables the user to readily move the table between the stored and use positions without the need to apply excessive force. Of course it should be understood that these arrangements are exemplary and in other arrangements other approaches may be used.

In exemplary arrangements the strap assembly 30 includes a flexible retaining strap 208 that is attached to the table 14 and extends substantially across the changing surface 18. In the exemplary arrangement the retaining strap 208 extends in a direction generally perpendicular to the wall 12 when the table 14 is in the use position. At an outer end 210 that is disposed furthest away from the wall, an anchor piece 212 is attached by a fastener 214 to the table via an opening in the table. A threaded insert 216 extends in the opening to further secure the fastener 214 and anchor piece 212 to the table.

Anchor piece 212 further includes a loop 218. The loop 218 engages a ring shaped connector 220. The ring shaped connector 220 is attached to the flexible strap 208. At an inner end 222 the strap 208 is attached to a buckle 224. The buckle enables selectively adjusting the length of the strap to suit the requirements of the user. The exemplary buckle 224 includes biased clip projections 226 that are releasably engageable in an end piece 228. The exemplary end piece 228 includes openings 230 that enable accessing the clip projections 226 to manually release the buckle from the end piece when desired. The exemplary end piece 228 is attached to an anchor piece 232. The anchor piece 232 is held to the table by a fastener 234 that extends in an opening in the table. A threaded insert 236 extends in the opening so as to further secure the anchor piece 232 to the table.

Thus the exemplary arrangement enables a user of a changing station to adjust the length of the flexible strap 208 to accommodate the size of the child, and to then secure the child in position on the changing surface by engagement of the buckle 224 with the end piece 228. To release the strap assembly 30 the user need only manually engage the clip projections 226 through the openings 230, to release the buckle and the end piece. The exemplary arrangement provides a secure connection that can be readily engaged and disengaged by users of the changing station. Of course these structures and approaches are exemplary and in other arrangements other approaches may be used.

Figure 43:
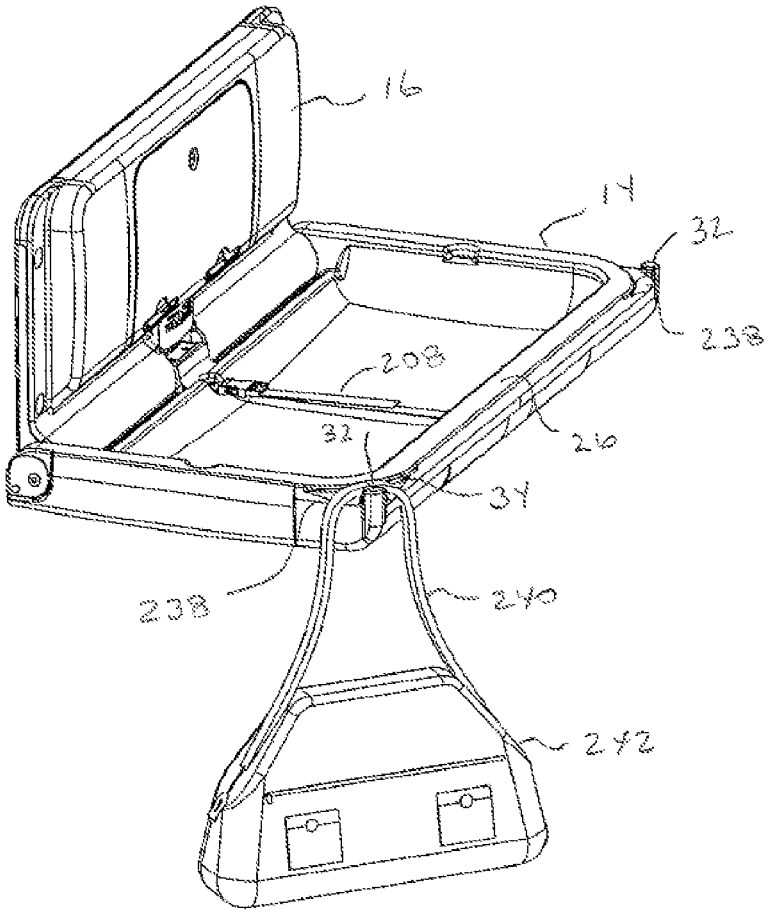
FIG. 43 is an upper right perspective view of the baby diaper changing station in a use position and showing a strap of a bag or other article carrying device in supported connection with an upward extending peg at a corner of the table.
Figure 44:
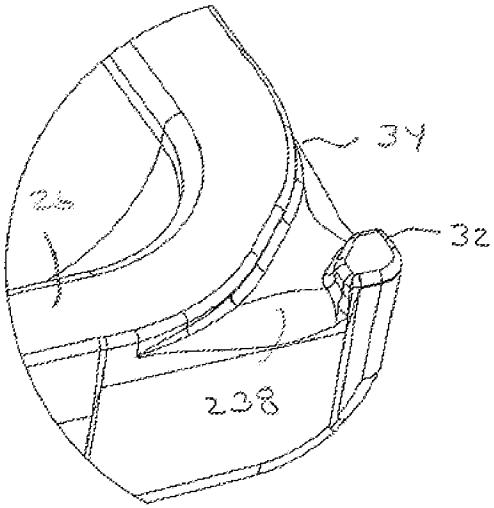
FIG. 44 is an enlarged perspective view of a portion of the rim of the table including the upward extending peg.
Figure 45:
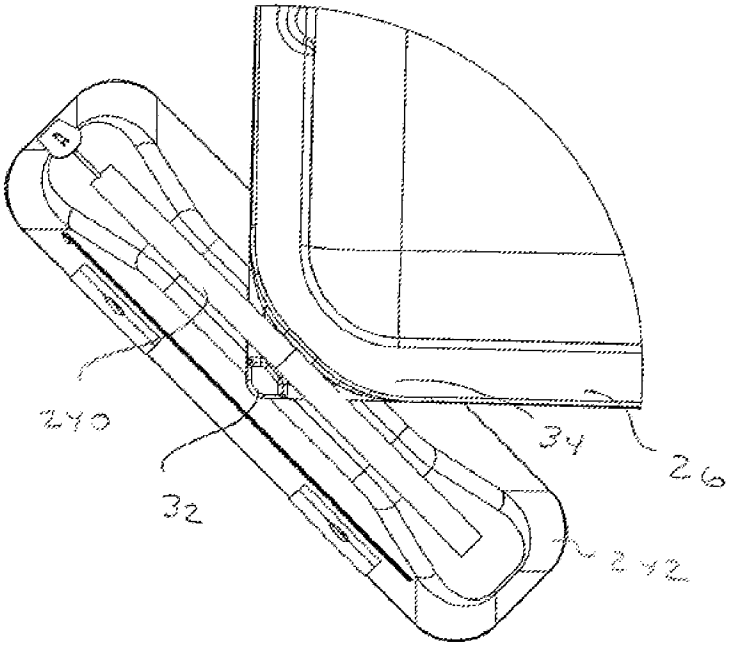
FIG. 45 is a top view showing the upward extending peg in engaged relation with the strap.

As shown in FIGS. 43-45 the exemplary arrangement provides enhanced holding capabilities for users who may have purses, diaper bags or containers for holding other items that they need to keep close or access while using the baby diaper changing station. In the exemplary arrangement the pegs 32 are configured to extend upwardly when the table 14 is in the use position. In the exemplary arrangement the peripheral surface 34 which bounds the rim 26, is configured adjacent to the pegs 32 to provide a recess 238 that extends inwardly around the pegs. As can be appreciated from FIGS. 43 and 45, the configuration of the pegs 32 and the recesses 238 enables securely engaging a strap 240 attached to a purse or other container 242, to be engaged with the upward extending peg 32. This configuration enables secure engagement of the strap 240 so that it is less likely to inadvertently disengage from the table. Further the exemplary arrangement enables the user to readily disengage the strap and the table when the user is done using the changing station. Of course it should be understood that this configuration is exemplary and other arrangements other approaches may be used.

Figure 41:
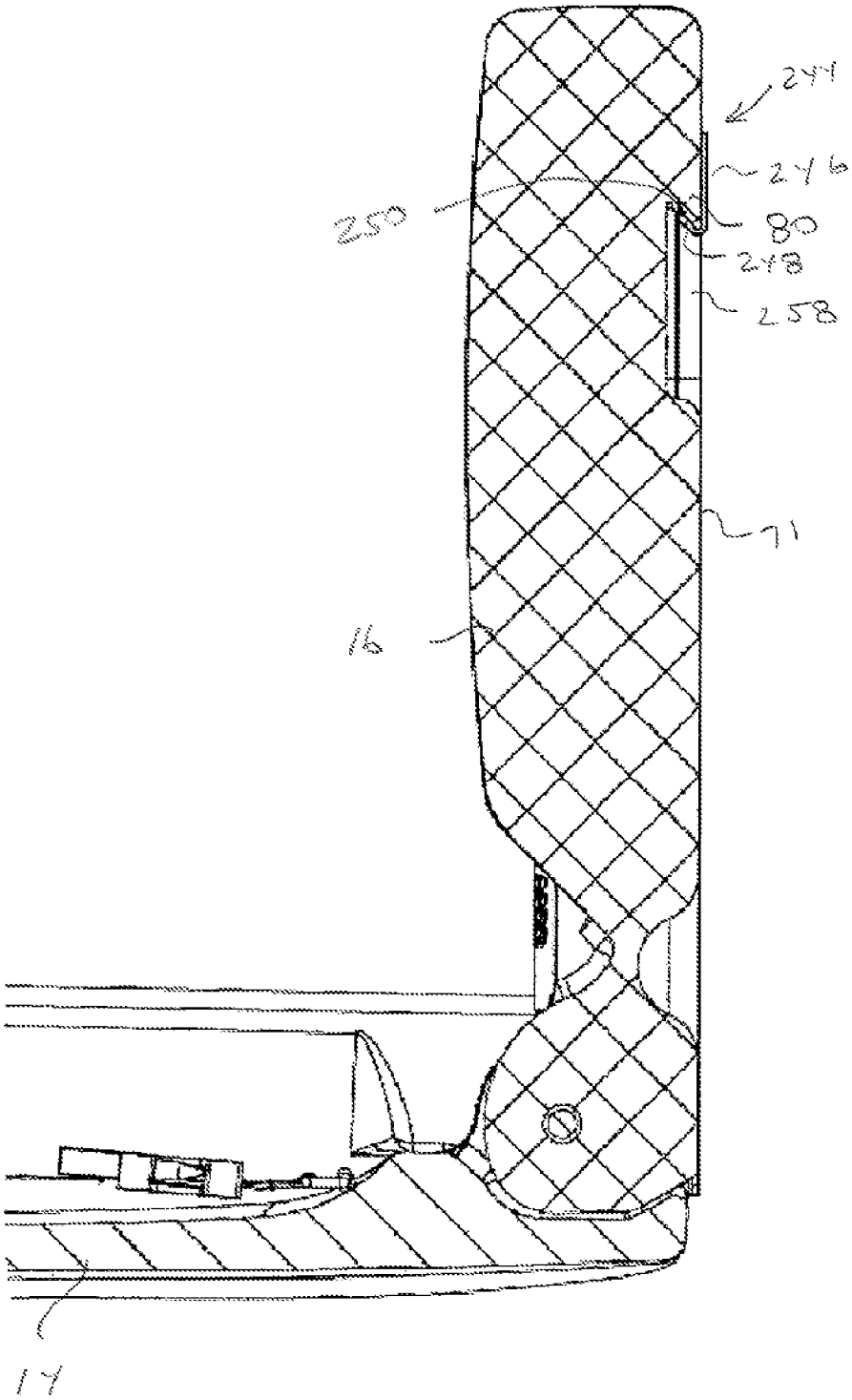
FIG. 41 is a transverse cross-sectional view of the base and the table, showing the base in engagement with the mounting bracket.

In exemplary arrangements the baby diaper changing station is readily securely mounted to the wall 12 or other vertically extending supporting surface. This is accomplished in exemplary arrangements as described in connection with FIGS. 39-42. The exemplary changing station is initially mounted to the wall 12 using a horizontally elongated mounting bracket 244. The exemplary mounting bracket 244 is a J shaped mounting bracket in transverse cross-section. The mounting bracket includes a back wall bracket side 246 that extends substantially parallel to the wall 12 as shown in FIG. 41. The bracket further includes in cross-section a front wall bracket side 248 that extends upward and outward from the back wall bracket side 246. The front wall bracket side extends further upwardly with increased distance outwardly away from the wall, and terminates in upward directed lip 250.

Figure 42:
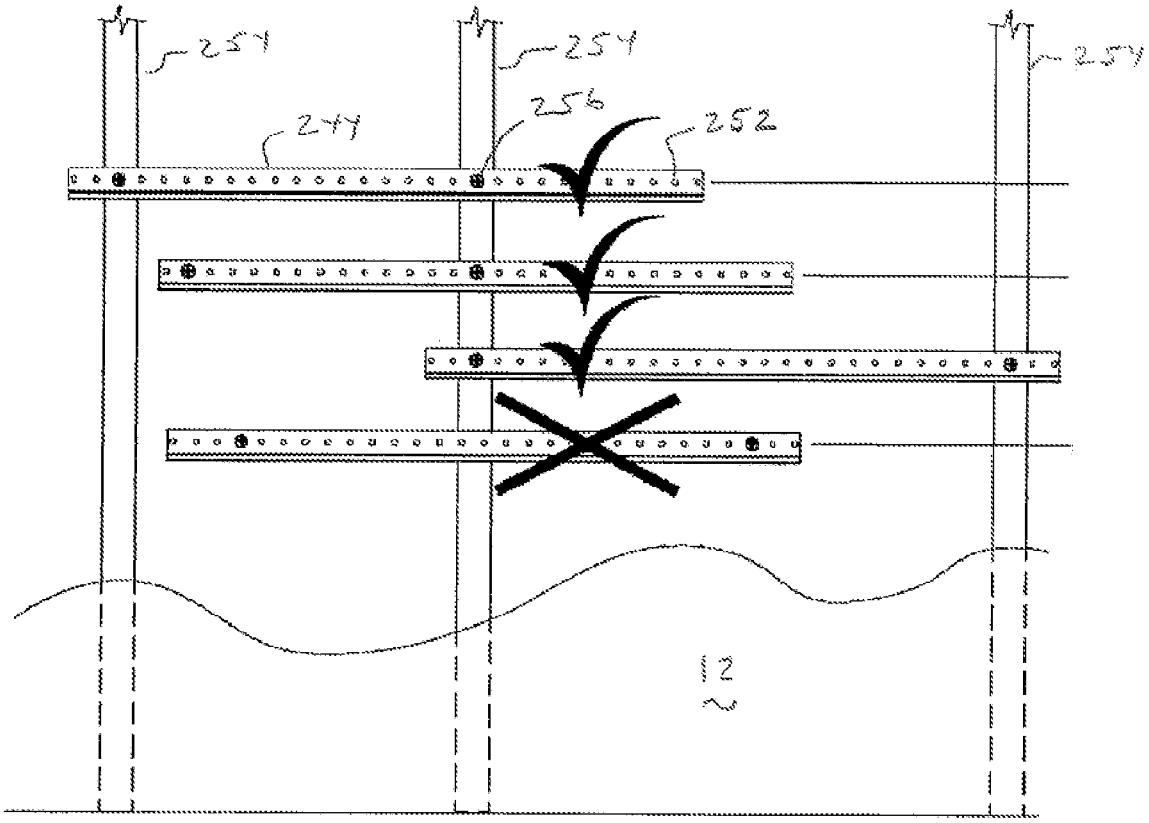
FIG. 42 shows a plurality of different possible mounting arrangements for the horizontally elongated mounting bracket relative to wall studs.

In the exemplary embodiment the back wall bracket side 246 includes a plurality of spaced openings 252. In the exemplary arrangement the spaced openings are configured for receiving fasteners therethrough such as screws. The openings are configured to enable the bracket 244 to be attached to at least one stud 254 which underlies the surface of wall 12. As represented in FIG. 42 the exemplary bracket 244 can be attached satisfactorily for mounting the changing station to one or more studs 254. In the exemplary arrangement fasteners 256 extend through the openings 252 and engage at least one stud. As represented in FIG. 42 satisfactory mounting of the exemplary baby diaper changing station 10 can be achieved as long as the mounting bracket 244 is engaged with at least one vertical stud 254. Examples of such mounting are represented by the top 3 mounting examples in FIG. 42. The lowermost example shown represents a situation where the mounting bracket 244 is not in direct connection through a fastener 256 with at least one stud. As indicated, this is generally not an acceptable mounting arrangement where the changing station is to be attached to a conventional stud frame wall. Of course it should be understood that in some exemplary arrangements, the changing station will be attached to a formed concrete wall, a block wall or other construction that is not a stud frame wall, in which case the mounting bracket 244 can be satisfactorily mounted as long as it is fastened in at least one location to a suitable high vertical load bearing structure.

In the exemplary arrangement the changing station 10 is initially mounted by the engagement of the front wall bracket side 248 and the lip 250 with the downward extending edge 80 on the back side of the base 16. As previously discussed in connection with FIG. 14, the edge 80 extends substantially continuously across the back surface 71 of the base between the back legs 86 of the base brackets 82, 84. For purposes hereof substantially continuously means that the edge is present for a majority of the transverse distance between the back legs. The edge 80 in cross-section has an underlying recess 258 which enables the front wall bracket side 248 and the lip 252 to extend in the recess 258 and securely engage the edge 80. As can be appreciated from FIG. 16, the mounting bracket 244 in engagement with the edge 80 extends transversely across the central recess 72 and provides supporting engagement substantially continuously across the entire horizontal span between the base brackets of the base as a result of engagement with the edge for a majority of such transverse distance.

Figure 39:
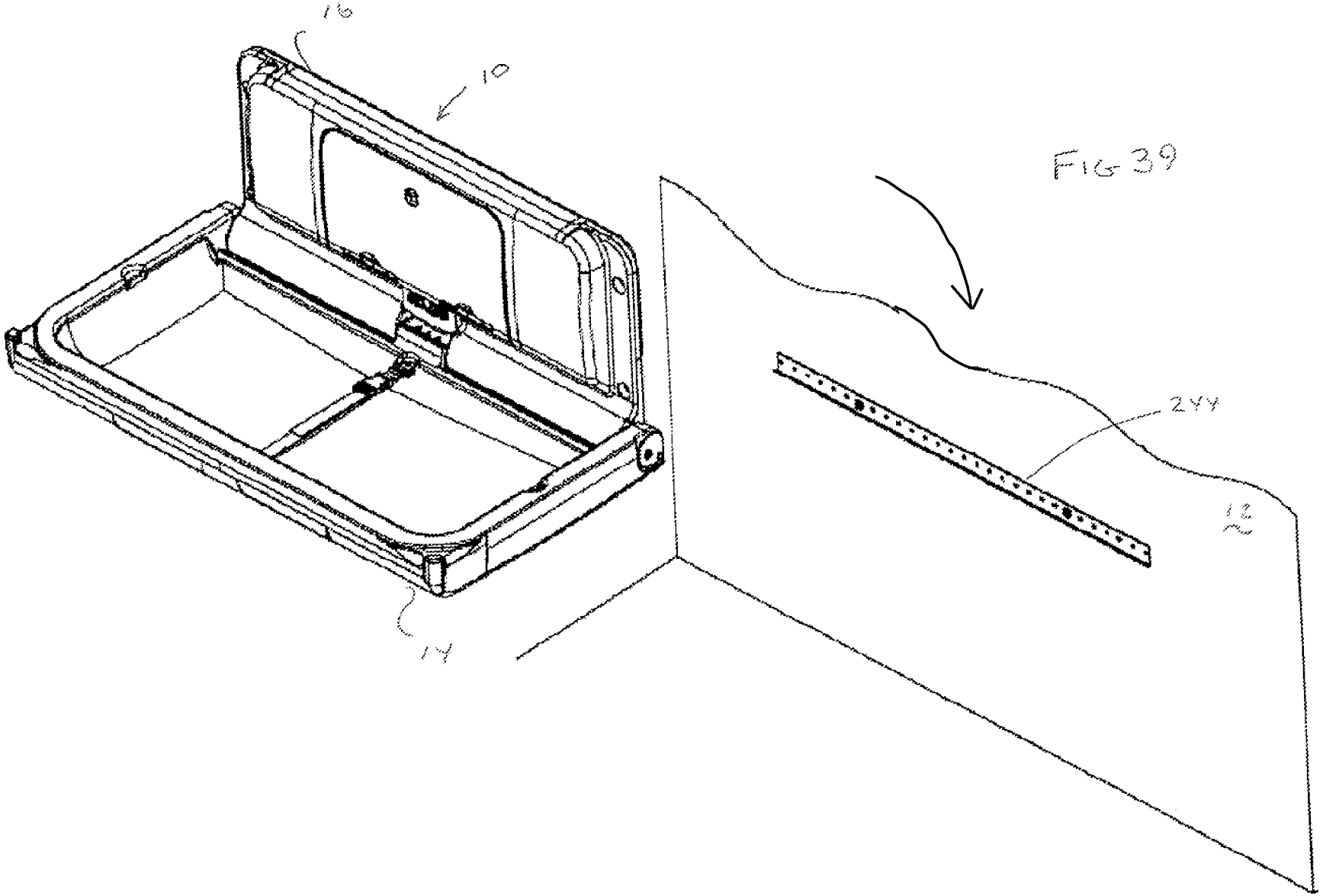
FIG. 39 is an exploded view showing the baby diaper changing station and a horizontally elongated mounting bracket attached to a wall.
Figure 70:
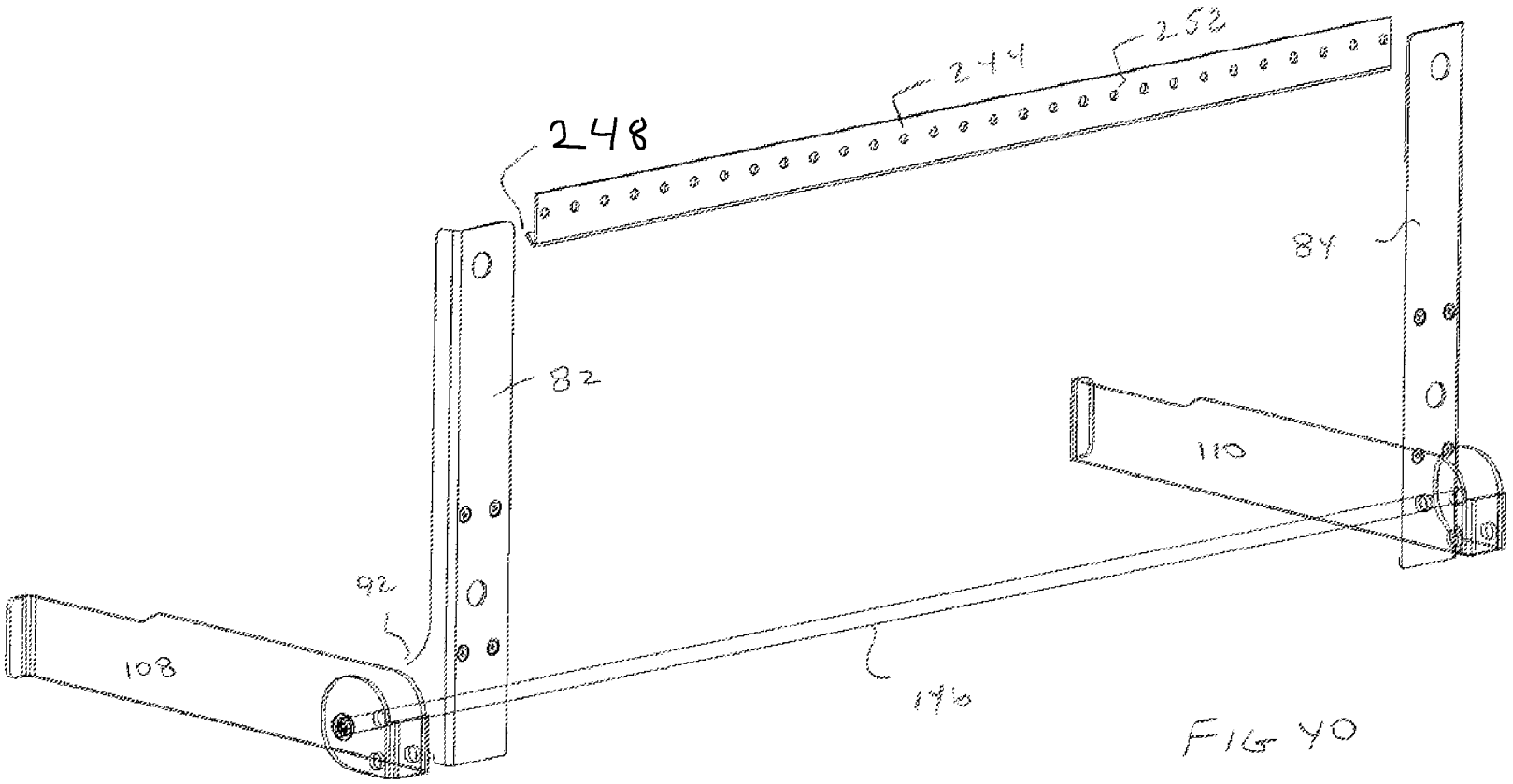

Thus in exemplary arrangements the mounting bracket 244 may be attached by fasteners 256 to the wall 12 in a horizontally level configuration such as is shown in FIG. 39. The changing station 10 may then be moved adjacent to the wall and the mounting bracket so that the edge 80 engages the lip 250 of the bracket in hook-like fashion. Once the base 16 is in hooked engagement with the mounting bracket 244, the base may be secured by using 4 anchors that extend through the openings 48 and into the wall 12. These anchors may be appropriate type wall anchors for the particular type of wall surface to which the changing station is to be engaged. As can be appreciated, the engaging structures of the exemplary arrangement which include the mounting bracket 244 which attaches to the base across a wide span in addition to the 4 mounting anchors that extend through the base, provide a solid mounting engagement of the base to the wall and for supporting the changing station. Of course it should be understood that these mounting structures are exemplary, and in other arrangements other structures and arrangements a be used.

Thus the exemplary arrangements of the baby diaper changing station described herein achieve improved operation, eliminate difficulties encountered in the use of prior devices and systems, and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the new and useful features are not limited to the exact features shown and described.

Having described the features, discoveries and principles of the exemplary arrangements, the manner in which they are constructed and operated, and the advantages and useful results attained, the new and useful structures, devices, elements, arrangements, parts, combinations, systems, equipment, operations, methods, processes and relationships are set forth in the appended claims.

We claim:

1. Apparatus comprising:

a baby diaper changing station including:

a base, wherein the base is configured to be in fixed operative connection with a vertically extending wall, a table, wherein the table includes a substantially planar changing surface, wherein the table is movably rotatably mounted in operative connection with the base, wherein the table is rotatable between a use position in which the table extends substantially horizontally and outward in a direction normal to the wall and in which the changing surface faces substantially upward, and a stored position in which the changing surface extends substantially vertically and parallel to the wall, wherein the table is bounded by an outer end surface, wherein the outer end surface extends furthest away from the wall when the table is in the use position, an inner end surface, wherein the inner end surface extends closer to the wall than the outer end surface when the table is in the use position, a pair of transversely disposed side wall surfaces, wherein each respective side wall surface extends between the inner end surface and the outer end surface, wherein the table includes a pair of straight transversely disposed linear channels, wherein the table extends in surrounding relation of each of the channels, wherein each channel extends from a respective channel opening in the inner end surface and toward the outer end surface, and is positioned transversely inward of a respective immediately adjacent side wall surface, wherein each channel extends at least halfway from the inner end surface to the outer end surface and terminates within the table, a pair of disposed rails, wherein a respective one of the rails extends in a respective channel from the respective channel opening at least halfway to the outer end surface, wherein each rail is in operative fixed connection with a rail end, wherein each rail end is proximate to the channel opening and is accessible externally of the table, wherein each rail end is in operative connection with an axle shaft portion, wherein each axle shaft portion is in operative connection with a respective rail end and extends along a common axis, wherein the table is rotationally movable about the axis between the use position and the stored position.

2. The apparatus according to claim 1 and further comprising:

a pair of clevises, wherein each respective clevis includes a respective rail end and a respective outboard end, wherein the outboard end is axially disposed from the respective rail end and transversely outwardly overlies the immediately adjacent side wall surface.

3. The apparatus according to claim 2 wherein each clevis further includes a bridge piece, wherein the respective bridge piece extends parallel to the axis and is in operatively fixed connection with each of a respective rail end and a respective outboard end, wherein the respective bridge piece extends perpendicular to each of the respective rail end and the respective outboard end.

4. The apparatus according to claim 3 wherein the inner end surface includes a pair of recessed notches, wherein each notch extends parallel to the axis and transversely between a channel opening and an immediately transversely adjacent side wall surface, wherein the bridge piece of a respective clevis extends in a respective notch.

5. The apparatus according to claim 4 wherein the respective axle shaft portion that is in operative connection with a respective rail end of a respective clevis, is also in operative connection with the outboard end of the respective clevis.

6. The apparatus according to claim 5 wherein the base is in operative fixed connection with a pair of transversely spaced ears, wherein each ear extends substantially normal to the wall and transversely inboard of a respective clevis, wherein the respective axle shaft portion that is in operative connection with the immediately transversely adjacent clevis, is also in operative connection with the respective ear.

7. The apparatus according to claim 6 wherein the base comprises a pair of transversely spaced base brackets, wherein each base bracket is generally L-shaped in transverse cross-section, and wherein each bracket includes a forward leg and a back leg, wherein the forward leg includes a respective ear, and wherein the back leg extends substantially parallel to the wall.

8. The apparatus according to claim 7 wherein the table includes a pair of transversely disposed stop pins, wherein each stop pin extends parallel to and is radially disposed from the axis, wherein each stop pin extends transversely inwardly of the respective immediately adjacent clevis, wherein each stop pin is operative to stop rotation of the table in a direction from the stored position toward the use position when the table is in the use position.

9. The apparatus according to claim 8 wherein each stop pin removably extends through respective pin openings in a respective outboard end and a respective rail end of a respective clevis.

10. The apparatus according to claim 9 wherein when the table is in the use position, each stop pin abuttingly engages a respective stop surface of a respective base bracket.

11. The apparatus according to claim 10 wherein each respective forward leg of a respective base bracket includes a respective stop surface.

12. The apparatus according to claim 11 wherein each forward leg includes a respective curved recess, wherein the curved recess is configured to receive a stop pin therein, wherein the respective stop surface bounds the curved recess.

13. The apparatus according to claim 12 wherein each stop pin is configured to deform intermediate of the stop surface and the clevis when the table is in the use position and downward force above a limit is applied to the table.

14. The apparatus according to claim 13 wherein each stop pin is removable transversely outwardly from the respective pin openings in a respective clevis.

15. The apparatus according to claim 14 wherein each stop pin includes an elongated cylindrical pin body that terminates at a radially enlarged outboard head, wherein the outboard head is in abutting relation with the outboard end of the respective clevis in which the pin extends.

16. The apparatus according to claim 15 wherein each stop pin includes a transversely inboard end, wherein the transversely inboard end is in engagement with the stop surface when the table is in the use position, wherein each stop pin includes a recess transversely intermediate of the clevis and the inboard end, and further comprising:

a pair of retainer clips, wherein each retainer clip is releasably engageable in a respective recess, wherein the respective radially enlarged outboard head and the respective retainer clip in engagement with the respective recess are operative to limit transverse movement of the respective stop pin to assure that in the use position the respective transversely inboard end of the stop pin engages the respective stop surface.

17. The apparatus according to claim 16
and further comprising:
an axle shaft,
wherein the axle shaft includes both axle shaft portions and extends through each ear and each clevis.

18. The apparatus according to claim 17
wherein the table further includes
a bearing block,
wherein the bearing block is transversely intermediate of the ears,
wherein the axle shaft extends through the bearing block.

19. The apparatus according to claim 17
wherein each rail comprises
an elongated plate, wherein the plate extends in a respective channel substantially parallel to the immediately adjacent side wall surface,
wherein each plate terminates inwardly in the channel in a turned inside end,
wherein each turned inside end extends substantially perpendicular to the immediately adjacent side wall surface.

20. The apparatus according to claim 19
wherein the table includes a rim,
wherein in the use position, the rim extends upward above the changing surface and between the changing surface and each of the side wall surfaces,
wherein each rail extends in a respective channel that extends within the rim.

21. The apparatus according to claim 20
wherein each channel includes a step intermediate of the channel opening and the turned inside end, wherein the channel is smaller in at least one dimension adjacent to the step,
wherein each rail includes a reduced area, wherein the reduced area is bounded by a step engagement surface that is in engagement with the step, and wherein the respective rail is reduced in the at least one dimension from the step engagement surface to the turned inside end.

22. The apparatus according to claim 21
wherein in the use position, the rim extends upward between the changing surface and the outer end surface,
wherein the rim is bounded in the use position horizontally by a peripheral surface,
wherein the peripheral surface includes at least one upward extending peg, wherein the at least one peg is configured to engage a downward extending strap.

23. The apparatus according to claim 21
wherein the base includes a back surface,
wherein the back surface is in facing relation with the wall,
wherein each respective back leg of each respective base bracket extends in attached connection with the back surface of the base and intermediate of the back surface and the wall.

24. The apparatus according to claim 23
wherein the back surface includes a recess,
wherein the recess is bounded at an upper side by a horizontally extending edge,
and further comprising:
a horizontally elongated mounting bracket,
wherein in transverse cross-section the mounting bracket includes a pair of bracket sides which form a J shape in cross-section,
wherein a back wall bracket side extends generally vertically and parallel to the wall and a front bracket side extends horizontally outward away from the back wall bracket side and upward, wherein the front wall bracket side extends further upward as the front wall bracket side extends further outward from the back wall bracket side,
wherein the front wall bracket side terminates in an upward and outward directed lip,
wherein the lip is in engagement with the horizontally extending edge.

25. The apparatus according to claim 24
wherein the horizontally extending edge extends substantially continuously between the back legs of the transversely disposed base brackets,
wherein the lip engages the edge substantially continuously between the back legs of the transversely disposed base brackets.

26. The apparatus according to claim 1
wherein the base further includes a pair of transversely disposed base brackets,
wherein each base bracket includes a respective ear that is in operative connection with a respective axle shaft portion, wherein each respective axle shaft portion is in operative engagement with a respective rail end,
wherein the base includes a back surface, wherein the back surface is in substantially facing relation with the wall, wherein the back surface includes a recess,
wherein the recess is bounded upwardly by a horizontally extending edge,
wherein the edge extends substantially continuously transversely between the base brackets,
and further comprising:
a horizontally elongated mounting bracket, wherein the mounting bracket is configured for attached engagement with the wall,
wherein the mounting bracket is J shaped in transverse cross-section and includes a front wall bracket side that terminates in a horizontally outward and upward extending lip,
wherein the lip is in substantially continuous engagement with the edge between the base brackets.

27. The apparatus according to claim 1
wherein the table inner end surface includes a pair of transversely disposed recessed notches,
wherein each respective recessed notch extends parallel to the axis and adjacent to a channel opening,
wherein each respective rail end is in fixed operative connection with a respective bridge piece, wherein each respective bridge piece extends substantially parallel to the axis and within a respective recessed notch.

28. The apparatus according to claim 1
wherein each respective rail terminates within the respective channel at a turned inside end,
wherein the turned inside end of each respective rail extends substantially perpendicular to the immediately adjacent side wall surface.

29. Apparatus comprising: a baby diaper changing station including a base, wherein the base is configured to be in fixed operative connection with a vertically extending wall, is in fixed operative connection with a pair of transversely disposed ears, a table, wherein the table includes a substantially planar changing surface, wherein the table is movably rotatably mounted in operative connection with the base, wherein the table is rotatable between a use position, wherein in the use position the table extends substantially horizontally and the changing surface faces substantially upward, and a stored position in which the table extends substantially vertically and parallel to the wall, wherein the table includes an inner end surface and an outer end surface, wherein in the use position the inner end of surface is disposed closer to the base than the outer end surface, and wherein in the use position the changing surface extends horizontally intermediate of the inner end surface and the outer end surface, wherein the inner end surface includes a pair of transversely disposed channel openings, wherein each channel opening is disposed transversely outboard of the base, wherein each channel opening is in connection with a straight linear channel that extends within the table from the channel opening and at least halfway from the inner end surface to the outer end surface, wherein the respective channel terminates within the table, a pair of rails, wherein one rail extends in a respective channel from the respective channel opening at least halfway from the inner end surface to the outer end surface, wherein each rail includes a rail end, wherein the respective rail end is accessible from outside of the table, a pair of axle shaft portions, wherein each axle shaft portion extends along an axis and transversely outward from the base, wherein a respective axle shaft portion is in rotatable engagement with a respective rail end, wherein each rail end is in operative rotatable connection with the base through a respective axle shaft portion, wherein each axle shaft portion is in operative connection with a respective ear, a pair of stop pins, wherein each respective stop pin extends transversely inwardly through a pin opening in a respective rail end and terminates transversely inwardly at a transversely inboard end, wherein the respective pin opening through the respective rail end through which the respective stop pin extends is radially disposed away from the axis, wherein each respective ear is part of a respective base bracket that includes a stop surface, wherein the transversely inboard end of a respective stop pin is in abutting relation with the respective stop surface of the respective base bracket when the table is in the use position, wherein each respective stop pin is configured to deform in an area of the stop pin transversely between the respective stop surface and the respective pin opening in the rail end when the table is in the use position and a downward force acting on the table is above a limit.

30. Apparatus comprising:

a baby diaper changing station including:

a base, wherein the base is configured to be in fixed operative connection with a vertically extending wall, a table, wherein the table includes a substantially planar changing surface, wherein the table is movably rotatably mounted in operative connection with the base, wherein the table is rotatable between a use position in which the table extends substantially horizontally and outward in a direction normal to the wall and in which the changing surface faces substantially upward, and a stored position in which the changing surface extends substantially vertically and parallel to the wall, wherein the table is bounded by an outer end surface, wherein the outer end surface extends furthest away from the wall when the table is in the use position, an inner end surface, wherein the inner end surface extends closer to the wall than the outer end surface when the table is in the use position, a pair of transversely disposed side wall surfaces, wherein each respective side wall surface extends between the inner end surface and the outer end surface, wherein the table includes a pair of straight transversely disposed linear channels, wherein the table extends in surrounding relation of each of the channels, wherein each channel extends from a respective channel opening in the inner end surface and toward the outer end surface, and is positioned transversely inward of a respective immediately adjacent side wall surface, wherein each channel extends at least halfway from the inner end surface to the outer end surface and terminates within the table, a pair of disposed rails, wherein a respective one of the rails extends in a respective channel from the respective channel opening at least halfway to the outer end surface, wherein each rail is in operative fixed connection with a rail end, wherein each rail end is proximate to the channel opening and is accessible externally of the table, wherein each rail end is in operative connection with an axle shaft portion, wherein each axle shaft portion is in operative connection with a respective rail end and extends along a common axis, wherein the table is rotationally movable about the axis between the use position and the stored position, a pair of stop pins, wherein a respective stop pin extends through and transversely inwardly from a respective rail end, and terminates transversely inwardly at a transversely inward end, wherein each transversely inward end of a stop pin is in abutting engaged relation with a respective stop surface that is in operative connection with the base, when the table is in the use position, wherein each stop pin is configured to fracture transversely intermediate of the rail end and the transversely inboard end when downward force on the table in the use position is above a limit.

31. The apparatus according to claim 30 wherein each stop pin includes a recess therein, and further including a pair of retainer clips, wherein a respective retainer clip is configured to releasably engage in a respective recess of a respective stop pin, wherein each retainer clip in engagement with a respective stop pin is configured to prevent transverse movement of the respective stop pin sufficient to cause the respective transversely inboard end not to be in engagement with the respective stop surface when the table is in the use position.

32. Apparatus comprising:
a baby diaper changing station including
a base,
wherein the base is configured to be in fixed operative connection with a vertically extending wall,
a table,
wherein the table includes a substantially planar changing surface,
wherein the table is movably rotatably mounted in operative connection with the base,
wherein the table is rotatable between
a use position, wherein in the use position the table extends substantially horizontally and the changing surface faces substantially upward, and
a stored position in which the table extends substantially vertically and parallel to the wall,
wherein the table includes an inner end surface and an outer end surface,
wherein in the use position the inner end of surface is disposed closer to the base than the outer end surface, and wherein in the use position the changing surface extends horizontally intermediate of the inner end surface and the outer end surface,
wherein the inner end surface includes a pair of transversely disposed channel openings, wherein each channel opening is disposed transversely outboard of the base,
wherein each channel opening is in connection with a straight linear channel that extends within the table from the channel opening and at least halfway from the inner end surface to the outer end surface, wherein the respective channel terminates within the table,
a pair of rails, wherein one rail extends in a respective channel from the respective channel opening at least halfway from the inner end surface to the outer end surface,
wherein each rail includes a rail end, wherein the respective rail end is accessible from outside of the table,
a pair of axle shaft portions,
wherein each axle shaft portion extends along an axis and transversely outward from the base, wherein a respective axle shaft portion is in rotatable engagement with a respective rail end,
wherein each rail end is in operative rotatable connection with the base through a respective axle shaft portion.

33. The apparatus according to claim 32
wherein the table is bounded transversely by a pair of transversely disposed side wall surfaces,
wherein each rail extends within the table in substantially parallel relation with an immediately adjacent side wall surface,
wherein the table further includes a pair of transversely disposed clevises, wherein each respective clevis includes of a respective rail end and a respective outboard end, wherein each outboard end extends substantially parallel to and transversely outwardly overlies the immediately adjacent side wall surface,
wherein each clevis includes a bridge piece, wherein the respective bridge piece extends substantially parallel to the axis and is in operatively fixed connection with each of the respective rail end and the outboard end of the respective clevis,
wherein a respective axle shaft portion extends through the rail end and the outboard end of each respective clevis.

34. The apparatus according to claim 33
wherein the inner end surface of the table includes a pair of transversely disposed recessed notches,
wherein a respective bridge piece of a respective clevis extends in a respective recessed notch.

35. Apparatus comprising:
a baby diaper changing station including:
a base,
wherein the base is configured to be in fixed operative connection with a vertically extending wall,
a table,
wherein the table includes a substantially planar changing surface,
wherein the table is movably rotatably mounted in operative connection with the base,
wherein the table is rotatable between
a use position in which the table extends substantially horizontally and outward in a direction normal to the wall and in which the changing surface faces substantially upward, and
a stored position in which the changing surface extends substantially vertically and parallel to the wall,
wherein the table is bounded by
an outer end surface, wherein the outer end surface extends furthest away from the wall when the table is in the use position,
an inner end surface, wherein the inner end surface extends closer to the wall than the outer end surface when the table is in the use position,
a pair of transversely disposed side wall surfaces, wherein each respective side wall surface extends between the inner end surface and the outer end surface,
wherein the table includes
a pair of linearly straight transversely disposed channels, each of which channels extends parallel to the changing surface,
wherein the table extends in surrounding relation of each of the channels,
wherein each channel extends from a respective channel opening in the inner end surface and toward the outer end surface, and is positioned transversely inward of a respective immediately adjacent side wall surface,
wherein each channel extends at least halfway from the inner end surface to the outer end surface and terminates within the table,
a pair of disposed linearly straight rails,
wherein a respective one of the rails extends in a respective channel from the respective channel opening at least halfway to the outer end surface,
wherein each rail is in operative fixed connection with a rail end,
wherein each rail end is proximate to the channel opening and is accessible externally of the table,
wherein each rail end is in operative connection with an axle shaft portion externally of the table, wherein each axle shaft portion extends along a common axis, wherein the table is rotationally movable about the axis between the use position and the stored position.

36. The apparatus according to claim 35 and further comprising:

a pair of clevises, wherein each respective clevis includes a respective rail end and a respective outboard end, wherein the outboard end is axially disposed from the respective rail end, is in rotationally operatively engaged relation with a respective axle shaft portion, and transversely outwardly overlies the immediately adjacent side wall surface.

* * * * *